US009841236B2

(12) United States Patent
Ernst et al.

(10) Patent No.: US 9,841,236 B2
(45) Date of Patent: Dec. 12, 2017

(54) SINTERING FURNACE WITH A GAS REMOVAL DEVICE

(71) Applicant: GKN Sinter Metals Holding GmbH, Radevormwald (DE)

(72) Inventors: Eberhard Ernst, Eichenzell (DE); Rene Albert, Motten (DE); Thomas Schupp, Scheuerfeld (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 218 days.

(21) Appl. No.: 14/385,655

(22) PCT Filed: Mar. 13, 2013

(86) PCT No.: PCT/EP2013/000732

§ 371 (c)(1),
(2) Date: Sep. 16, 2014

(87) PCT Pub. No.: WO2013/135373

PCT Pub. Date: Sep. 19, 2013

(65) Prior Publication Data

US 2015/0050610 A1 Feb. 19, 2015

(30) Foreign Application Priority Data

Mar. 16, 2012 (DE) ..... 10 2012 005 180

(51) Int. Cl.
*F27D 7/06* (2006.01)
*F27B 21/06* (2006.01)
(Continued)

(52) U.S. Cl.
CPC ..... *F27B 21/06* (2013.01); *C22F 1/18* (2013.01); *C22F 1/183* (2013.01); *F27D 3/12* (2013.01);
(Continued)

(58) Field of Classification Search
CPC . F27D 9/028; F27D 9/029; F27D 7/06; C22B 1/20
(Continued)

(56) References Cited

U.S. PATENT DOCUMENTS 3,244,507 A * 4/1966 Linney ..... C22B 1/2413 266/175
3,708,157 A * 1/1973 Aubry ..... F27B 9/045 432/126
(Continued)

FOREIGN PATENT DOCUMENTS

EP 0378877 A1 7/1990
EP 0566376 A1 10/1993
(Continued)

OTHER PUBLICATIONS

Japan Patent Office, Notice of Reasons for Rejection with English translation for corresponding Japanese Patent Application No. 2014-561318, dated Oct. 22, 2015, 16 pages.
(Continued)

*Primary Examiner* — Gregory A Wilson
(74) *Attorney, Agent, or Firm* — Quarles & Brady LLP

(57) ABSTRACT

A sintering furnace with a first zone, in particular a burn-off zone, and a second zone, in particular a sintering zone, and also a transitional zone arranged between the first zone and the second zone. The sintering furnace has at least one transporting mechanism for transporting bodies to be sintered on a transporting area. With this transporting mechanism, the bodies to be sintered can be transported from the first zone and through the transitional zone to the second zone. The sintering furnace also has at least one gas removal device with at least one gas removal device opening. Here, the gas removal device opening is at least partially arranged in the region of the transitional zone. Furthermore, a method
(Continued)

Figure 1A:
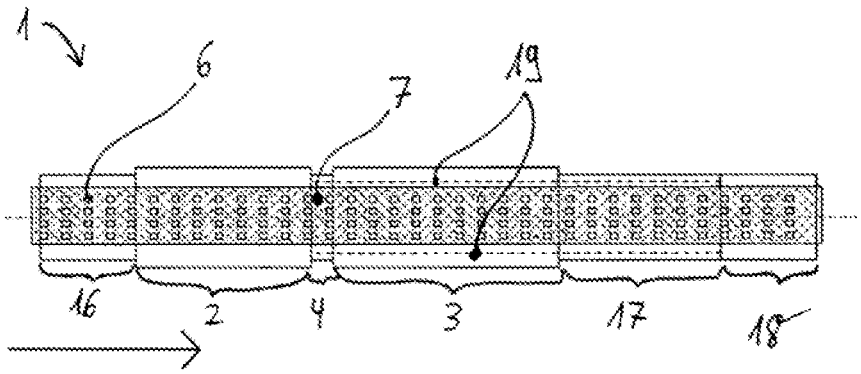
Prior Art Fig. 1a

by means of which gases can be removed from a sintering furnace is claimed.

28 Claims, 19 Drawing Sheets

(51) Int. Cl.

| | |
|---|---|
| ***F27D 17/00*** | (2006.01) |
| ***C22F 1/18*** | (2006.01) |
| ***F27D 3/12*** | (2006.01) |
| ***F27D 7/00*** | (2006.01) |
| ***F27D 21/00*** | (2006.01) |

(52) U.S. Cl.
CPC ..... *F27D 7/00* (2013.01); *F27D 17/001* (2013.01); *F27D 17/004* (2013.01); *F27D 21/00* (2013.01)

(58) Field of Classification Search
USPC ..... 432/122, 123, 128, 133, 136, 152, 176; 266/252, 254, 81
See application file for complete search history.

(56) References Cited

U.S. PATENT DOCUMENTS

| | | | | |
|---|---|---|---|---|
| 4,168,951 | A * | 9/1979 | Drugge | C22B 1/20 432/106 |
| 4,221,559 | A * | 9/1980 | Feichtner | C22B 1/20 266/178 |
| 4,536,211 | A | 8/1985 | Futakuchi et al. | |
| 5,074,533 | A * | 12/1991 | Frantz | B22F 3/003 266/252 |
| 6,261,091 | B1 * | 7/2001 | Sakamoto | C03C 17/002 432/11 |
| 7,018,584 | B2 * | 3/2006 | Serafini, Jr. | B22F 3/1028 266/252 |
| 7,568,914 | B2 * | 8/2009 | Okano | C03B 29/08 432/121 |
| 9,109,958 | B2 * | 8/2015 | Katsumata | F27B 5/18 |
| 2008/0226489 | A1 * | 9/2008 | Sakata | B22F 3/101 419/38 |
| 2012/0055592 | A1 * | 3/2012 | Zurecki | C21D 1/667 148/578 |
| 2016/0069615 | A1 * | 3/2016 | Choo | F27D 3/04 75/386 |

FOREIGN PATENT DOCUMENTS

| | | | |
|---|---|---|---|
| JP | 61-264102 | A | 11/1986 |
| JP | 02-017383 | A | 1/1990 |
| JP | 2009-229013 | A | 10/2009 |
| WO | 9527802 | A1 | 10/1995 |

OTHER PUBLICATIONS

PCT International Search Report, PCT/EP2013/000732, dated Aug. 21, 2013, 3 pages.

* cited by examiner

SINTERING FURNACE WITH A GAS REMOVAL DEVICE

CROSS-REFERENCE TO RELATED APPLICATIONS

This application represents the national stage entry of PCT International Application No. PCT/EP2013/000732 filed Mar. 13, 2013, which claims priority of German Patent Application No. 10 2012 005 180.8 filed Mar. 16, 2012, the disclosures of which are incorporated by reference here in their entirety for all purposes.

The invention relates to a sintering furnace with a gas removal device, wherein the gas removal device makes an efficient removal of exhaust gases from the sintering furnace possible. Furthermore, a method is proposed for removing gases from a sintering furnace.

Sintering furnaces are known through which bodies to be sintered run. The bodies to be sintered are first transported through a burn-off zone in which lubricants and/or waxes present in the bodies to be sintered are removed by being burned off at temperatures lower than the sintering temperature. Such sintering furnaces have the so-called sintering zone, in which the actual sintering process takes place, directly or indirectly behind the burn-off zone. An advantage of such sintering furnaces is the possibility of sintering a large number of bodies to be sintered in a short time in a continuous or largely continuous process. However, a disadvantage of the described sintering furnaces is the fact that the furnace is open at least on its inlet side and on its outlet side. As a result of this and as a result of the lack of separation of the different areas of the sintering furnace, a convection and/or diffusion of contaminants through the openings and between the different areas of the sintering furnace is possible. These contaminants can result, in particular during the sintering process, in a deterioration of the sintered bodies if a diffusion of the contaminants into the surface of the bodies takes place and/or if chemical reactions with the contaminants take place on the surface of the bodies. In addition, a diffusion of undesirable elements, for example, oxygen, starting from the surface of the bodies into the volume of the bodies, and/or reaction products being produced can lead to a change of the material properties that can manifest in undesirable properties. Also, atoms present in the bodies diffusing towards the surface of the body due to a possible reaction taking place there with substances present in the atmosphere surrounding the bodies can result in a deterioration of properties of the body. Examples of the last-mentioned mechanism are the mechanisms of partial decarburization and decarburization. Frequently, reduced hardnesses and/or greater brittleness occur as examples of undesired consequences.

CONFIRMATION COPY

The object of the invention is to provide a sintering furnace with which sintered bodies having an improved quality can be produced.

The object is achieved with a sintering furnace having the features of claim 1 as well as with a method having the features of claim 15. Additional advantageous embodiments and refinements are apparent from the following description. One or more features from the claims, the description as well as the figures can be linked with one or more features from them to additional embodiments of the invention. In particular, one or more features from the independent claims can also be replaced by one or more other features. The proposed subject matter is only to be considered as an outline for the formulation of the invention but without limiting it.

A sintering furnace is proposed, comprising a first zone, a second zone and a transitional zone disposed between the first zone and the second zone. Furthermore, the sintering furnace comprises at least one transport mechanism, which enables a transport of bodies to be sintered on a transporting surface from the first zone through the transitional zone to the second zone. Furthermore, the sintering furnace comprises at least one gas removal device having at least one gas removal device opening. The gas removal device opening is disposed at least partially in an area of the transitional zone.

It is provided in the described sintering furnace that bodies to be sintered are transported by a transporting mechanism on a transporting surface through the furnace. The bodies to be sintered can rest directly on the transporting surface or also be collected on or in transporting devices, which in turn rest on the transporting surface. The transporting devices can be, for example, graphite plates or ceramic plates. For example, containers open on one side, such as cups, boxes or buckets, which may be made, for example, of ceramic, graphite, wire mesh or sheet metal, can also be provided. Embodiments are possible in which the bodies to be sintered are transported with the transporting surface by moving the transporting surface along the direction of transport. As an example of this, the transporting surface can be designed, for example, as a belt, in particular as a conveyor belt. Possibilities for the design of the conveyor belt include, for example, a wire mesh consisting of metals or metal alloys having a sufficiently high melting temperature or ceramic belts. In such a design of the transporting surface as a belt, its movement is brought about by the transporting mechanism. The transporting mechanism can comprise, for example, rotating rollers. Another possible design of a transporting mechanism is found in the so-called walking beam furnace, in which the transporting surface is formed by so-called walking beams on which bodies to be sintered can be placed. A transport of the bodies to be sintered through the sintering furnace takes place in a walking beam furnace by a transporting of the walking beams with the aid of an appropriate lifting mechanism, which, among other things, entails a transitory movement of the walking beams that causes the bodies to be sintered to be further transported from the burn-off zone to the sintering zone of the sintering furnace. Another possibility for designing a sintering furnace is the construction as a pusher type furnace. In a pusher type furnace, the bodies to be sintered are disposed directly or indirectly on a base surface which, in this embodiment, represents a transporting surface that is stationary inside the sintering furnace. The transporting of the bodies to be sintered can take place in a pusher type furnace, for example, with the aid of a push by a corresponding pushing device disposed in an area of the furnace inlet. Another possibility of designing a sintering furnace in which bodies to be sintered are transported is the design as a roller conveyor furnace. In a roller conveyor furnace, the transporting surface is formed by rollers on which the bodies to be sintered are directly or indirectly disposed. Potential transporting mechanisms here are, on the one hand, rollers drivable, for example, with the aid of motors, via which a momentum transfer to the bodies to be sintered can take place, or else a momentum transfer to the bodies to be sintered that takes place via a pushing mechanism, similar, for example, to a pusher type furnace, and the bodies to be sintered are then transported, in this case, by non-drivable rollers. A combination of drivable and non-drivable rollers can also be provided for forming the transporting surface. An advantage of the roller conveyor furnace is the fact, for example, that the roller conveyor furnace can usually be used at higher temperatures than, for example, a sintering furnace embodied as a sintering conveyor furnace. Another advantage of the roller conveyor furnace is that the movement speed of the bodies to be sintered along the longitudinal extent of the sintering furnace can vary, so that, for example, the dwell time inside an area of the sintering furnace can be adapted to the design of the particular process.

In the sintering furnace described, it is provided that a gas removal device having at least one gas removal device opening is disposed at least partially in an area of the transitional zone. The arrangement at least partially in an area of the transitional zone means that at least not the entire gas removal device opening is disposed inside the first zone or inside the second zone.

In the case of sintering furnaces used in particular for industrial manufacture, zones with different functionality are generally situated one behind the other. In practically all embodiments of a sintering furnace, at least one burn-off zone and one sintering zone form part of the sintering furnace in an intended direction of passage of the bodies to be sintered. In addition, a compensation zone, a carburization zone, a sudden cooling zone for carrying out hardening processes, a starting zone and/or a cooling zone can also be disposed in the sintering furnace, whereby in this case as well, the different zone types are specified in accordance with a typical arrangement in an intended direction of passage. However, individual zone types can also be multiply disposed in the sintering furnace, for example, in order to carry out the appropriate functionality at different temperatures and/or in different atmospheres. Furthermore, not all of the aforementioned zone types are necessarily present in a sintering furnace. The sequence indicated is a typical sequence in which the appropriate zone types are typically disposed; however, in case of need a reversal of the sequence can be provided, for example, hardening processes and starting processes can be connected sequentially in a flexible manner. In all cases, a transitional zone can be provided between different zones. The transitional zone serves here, among other things, the purpose of separating, at least to a certain degree, the atmospheres from each other that prevail in successively disposed zones. A utilization of the gas removal device can be exploited at least partially inside transitional zones between any of the aforementioned zones or other zones as well.

In one embodiment of the sintering furnace, the transitional zone comprises at least one area whose smallest cross-sectional surface is smaller than the cross-sectional surface of at least one zone bordering on the transitional zone. In this embodiment, for example, from the view of a transitional zone disposed between a burn-off zone and a sintering zone, therefore, for example, from the view in the direction of movement of the bodies to be sintered from the end of the burn-off zone through the transitional zone to the start of the sintering zone, the cross section within the transitional zone, from the view along the longitudinal extent of the sintering furnace, is at least smaller in areas than the cross section of the areas directly adjacent to the transitional zone, or else an area with a narrowed cross section is also located in an area of the transitional zone. Depending on the design, it can also be possible that the area of the sintering zone having the smallest cross section of the sintering furnace is present in an area of the transitional zone or within the transitional zone. The result is, among other things, that gases flowing from the first zone into the second zone and/or gases flowing from the second zone into the first zone are forced to pass a cross section that is narrowed in comparison to the areas bordering on the transitional zone. The resultant flow conditions present in the area of the transitional zone have proven in many cases to be advantageous for the quality of the sintered bodies.

It is provided in another embodiment that at least one potentially interchangeable cross-section-narrowing body is disposed at least partially in an area of the transitional zone above the transporting surface. The advantage of an interchangeable, cross-section-narrowing body is that during the construction of the sintering furnace, the size of the cross section and the trend of the cross section with the longitudinal extent of the transitional zone do not have to be known, but rather are variable depending on the process design. However, even one or more permanently mounted, and therefore non-interchangeable, cross-section-narrowing bodies can be provided. The cross-section-narrowing body can basically be a body having any geometry and consisting of any material, whereby a selection of material that is suitable for the particular process is a prerequisite for usability. For example, it is necessary for the cross-section-narrowing body to be thermodynamically stable at the temperatures prevailing in the transitional zone. Furthermore, a selection of the material of the cross-section-narrowing body is advantageous to the extent that no substantial outgassing of substances undesirable for the process atmosphere takes place, and that any chemical reactions with the particular process atmosphere used do not occur. In terms of this requirement profile, it can be provided, for example, for many cases that ceramic bodies are used as cross-section-narrowing bodies that can be designed, for example, as a plate. The cross-section-narrowing body in this case can be fastened within the transitional zone to one or more side walls and/or else on the upper wall. The fastening can be carried out, for example, with a screw connection, a non-separable or separable connection with other connection elements or by suspension in an appropriate suspension device, wherein the latter can be carried out, for example, by suspending one or more loops introduced in the cross-section-narrowing body into hooks appropriately attached in an area of the transitional zone. Furthermore, it is possible, for example, that a plurality of cross-section-narrowing bodies can be disposed at different positions between the first zone and the second zone. In all cases, it can also be possible that an at least partial projecting of one or more cross-section-narrowing bodies into the first zone and/or into the second zone can be possible, wherein a projecting of one or more of the cross-section narrowing bodies into only one or also into both of the adjacent zones can be possible.

In another embodiment, it is provided that in one area of the transition zone, at least one cross-section-changing body, which can be moved into the transitional zone and out of the cross section of the transitional zone, is disposed above the transporting surface. The cross-section-changing body provided can be disposed in a moved-in state, in this case, similar to the interchangeable cross-section-narrowing body. The advantage of a design as a cross-section-changing body that can be moved in and moved out in contrast to a design as a cross-section-narrowing body which, though optionally interchangeable, is immovable in the disposed state, is that a simplified moving in and moving out is facilitated. As a result, a change of the sintering process in terms of the process characteristics is made possible within a certain parameter range by designing the sintering furnace in an area of the transitional zone without expensive retrofitting measures. The cross-section-changing body can be, for example, a ceramic plate that can be moved into the cross section of the transitional zone.

In another embodiment, it is provided that the cross-section-narrowing body is designed as a lamella and that at least two lamellas are disposed successively at a distance from each other in the longitudinal direction of the sintering furnace, whereby at least one lamella is disposed within the transitional zone. It can be provided, for example, that the lamellas have a width that corresponds to or almost corresponds to the spacing between the inside walls of the sintering furnace, designed, for example, as muffle walls. However, it can also be provided that the lamellas are significantly narrower than the spacing between the inner walls of the sintering furnace, and that several lamellas, viewed in the transport direction of the bodies to be sintered, are positioned adjacent to each other. Furthermore, it can be provided that, viewed vertically to the transport direction of the bodies to be sintered, lamellas are positioned displaced relative to each other. Furthermore, it can be provided that one or more of the lamellas have different widths, thicknesses and/or lengths. It can also be provided that one or more of the lamellas, viewed in parallel projection onto the transporting surface, are positioned relative to each other in other than a parallel alignment. The lamellas can consist of any material such as, for example, of a metal alloy or of ceramic material. In one advantageous embodiment, it can be provided that the lamellas are disposed in an alignment parallel to one another. It can also be provided that the lamellas are spaced apart from one another a distance that is preferably approximately between 100 mm and 200 mm, preferably between 130 mm and 170 mm. The advantage of a cross-section-narrowing body embodied as a lamella or, when more than one lamella is arranged inside the sintering furnace, as an aggregate of lamellas, is that the flow of gases in areas of the sintering furnace fitted with lamellas is stabilized. This is brought about by, among other things, the fact that the lamellas influence the gas flow to the extent that turbulences of the gas flow that stabilize the flow are caused by the lamellas. It can furthermore also be provided that a few or several lamellas are disposed inside one or several of the zones. In this case, it can be provided, for example, that the aggregate of lamellas extends in an overlapping manner from an area of a transitional zone into an area of a zone adjacent to the transitional zone. Furthermore, it can be provided that the aggregate of lamellas extends from an area of one zone to an area of another zone, and lamellas can also be disposed in other zones and/or transitional zones between these two zones. However, it can also be provided that an aggregate of lamellas is disposed solely inside one zone or inside several zones, but on the other hand no lamella is disposed inside an adjacent transitional zone.

In one embodiment of the invention, it is provided that the gas removal device opening is disposed completely in one area of the transitional zone. This avoids a projecting or at least a partial projecting into the first zone and/or into the second zone. As a result, a largely completely conceptual separation of the first zone from the second zone is made possible by the transitional zone.

In one embodiment of the sintering furnace, it is provided that the gas removal device opening is disposed at least partially at the level of the transporting surface or below the level of the transporting surface. One advantage of such an arrangement is that the gas removal device opening is suitable for removing gases that flow around or below the bodies located in the sintering furnace.

In another embodiment, it is provided that the gas removal device opening is disposed at least partially, preferably completely, above the transport level of the transporting surface. One advantage of such an arrangement is that the gas removal device opening is suitable for removing gases that flow out of one of the two zones adjacent the transitional zone in which the gas removal device is disposed, into the transitional zone, and that gas flowing from the other of the two adjacent zones flows under the gas removal device opening.

Furthermore, it can be provided that at least one gas removal device opening is disposed at least partially, preferably completely, at the level of the transporting surface or below the level of the transporting surface, and that additionally, another gas removal device opening is disposed at least partially, preferably completely, above the transporting level of the transporting surface. In such a case it is especially advantageous that, starting from the first-mentioned gas removal device opening, the gas removal device associated with it runs substantially downward, whereas, starting from the second-mentioned gas removal device opening, the gas removal device associated with it runs substantially upward.

Thus, depending on the design of the first and of the second zone, the prevailing atmospheric conditions and, in particular, on the gas temperatures and the prevailing flow conditions, it is possible with an appropriate arrangement of the gas removal device and the gas removal device opening, respectively, the gas removal devices and the gas removal device openings, for gas flowing upward by a convection in an area of the transitional zone and/or gas flowing downward within the transitional zone is/to be conducted out of the sintering furnace. Therefore, gas currents, as a result of the targeted removal, can be separated from one another at least to a certain degree in accordance with the prevailing flow conditions and, in particular, the prevailing convection.

In one embodiment of the invention, it is provided that the parallel projection of the gas removal device opening extends onto the transporting surface at least over almost the entire width of the transporting surface. In a preferred embodiment, the parallel projection of the gas removal device opening extends at least over the entire width of the transporting surface. The width of the transporting surface refers here to the extension that the transporting surface exhibits vertically to the direction of movement of the bodies. For example, it can be provided that the gas removal device opening extends in the area of the transitional zone along the width of the inner walls of the sintering furnace, designed, for example, as muffle walls. The advantage of the extension of the gas removal device over the entire or at least almost the entire width of the transporting surface is that it creates a largely homogeneous flow of gas or underflow of gas for all bodies to be sintered located on the transporting surface. To this end it can also be provided that the width of the gas removal device is greater than the width of the transporting surface, therefore, the parallel projection of the gas removal device opening on the transporting surface in its extension projects at least over the entire width of the transporting stretch. In another embodiment, it is provided that the parallel projection of the gas removal device opening extends over the entire space between the lateral partition walls of the sintering furnace. A gas removal device opening designed in this manner ensures that the amount of gas removed by the gas removal device opening is maximized by preventing gas flowing from the first zone in the direction of the second zone from passing laterally outside the area of the extension of the gas removal device.

In one embodiment of the invention, the sintering furnace comprises at least one flow-through change component disposed inside the gas removal device. With the aid of the flow-through change component, it is possible to adjust the volume flow flowing through the gas removal device. The flow-through change component in this case can be, for example, a valve. Such a valve can be designed, for example, as a manually activated valve, medium-activated valve, machine-activated valve, electromagnetic valve, electrically activated valve, pneumatically activated valve, hydraulically activated valve or a spring- and weight-loaded valve.

In another embodiment of the invention, the sintering furnace comprises at least one convection-forcing device disposed within the gas removal device. With the aid of the convection-forcing device, it is possible to increase the volume flow flowing through the gas removal device. The convection-forcing device in this case can be designed, for example, as a compressor in the broader sense, for example, as a ventilator for forcing convection with a low pressure ratio between the intake side and the pressure side of approximately between 1 and 1.1, or as a blower with a pressure ratio between the intake side and the pressure side that is higher in comparison to the previously mentioned values.

In one embodiment, it is provided that at least one introduction device is disposed in an area of the transitional zone substantially opposite the gas removal device opening for introducing protective gas. The term protective gas in this case refers in general to a gas that is provided for direct or indirect introduction into the sintering zone during the sintering process, for example, in an area of the sintering zone and/or originating from the furnace discharge. This can be, for example, an inert gas such as, for example, argon, krypton, xenon or mixtures thereof. However, it can also involve other gases and/or gas mixtures, whereby it is advantageous if the chemical reactivity between the protective gas and the bodies to be sintered at the respective sintering temperature used is low. It is customary, for example, in many cases to use a gas mixture of nitrogen $N_2$ and hydrogen $H_2$ as protective gas, whereby typical gas mixtures are composed, for example, of 70% by volume $N_2$ and 30% by volume $H_2$, or of 95% by volume $N_2$ and 5% by volume $H_2$, or else within the composition range situated between these two compositions.

The introduction device can be, for example, a nozzle or several nozzles through which the protective gas, similar to a veil, is admitted into the sintering furnace, preferably over the entire width of the sintering furnace and/or, however, also over a part of the longitudinal extension or the substantially entire longitudinal extension of the transitional zone. An introduction of the protective gas via the introduction device can take place here under a comparatively high pressure so that the introduced gas has a high kinetic energy.

In another embodiment, it is provided that the volume flow can be adjusted with the aid of gas conducted by the gas removal device out of the sintering furnace. The volume flow can preferably be regulated with the aid of the gas removed by the gas removal device out of the sintering furnace. A regulation of the volume flow can take place here, for example, with the aid of a two-step controller or a three-step controller. A change of the volume flow can be made here separately or in combination with each other, for example, by an adjustment with the aid of the flow-through change component, the convection-forcing device and/or the speed of the protective gas introduced with the aid of the introduction device into the sintering furnace.

In another embodiment, it is provided that the gas removal device, starting from the gas removal device opening, extends to a heat exchanger. Gas can thereby be conducted from the sintering furnace to the heat exchanger in order to heat fluid in the heat exchanger. In particular, it can be provided that protective gas is heated for later introduction into the sintering furnace. The advantage of this is that pre-heated protective gas can be used for being introduced into the sintering furnace, as a result of which the energy expenditure to be applied for maintaining or achieving the temperature provided in the appropriate zone can be reduced, as compared to a heating of protective gas, which occurs only inside one of the zones of the sintering furnace, for example, the sintering zone or the cooling-off zone. It can furthermore be provided that the temperature of fluids is raised inside the heat exchanger for other uses. For example, gases can be preheated, such as combustion air for use in the burn-off zone, fuel gas for use by burners used in the burn-off zone and/or for gas heating of furnaces operated with gas. The heat exchanger is in particular a recuperator, for example, a plate heat transmitter, a spiral heat transmitter, a tubular heat transmitter, a U-tube heat transmitter, a jacket tube heat transmitter, a heating register and/or a stacked heat transmitter.

In one embodiment of the invention, it is provided, for example, that the first zone is a burn-off zone and that the second zone is a sintering zone. In such case, an area of a sintering furnace is present in which a burn-off zone and a sintering zone are arranged in succession, and the two zones are separated from one another by a transitional zone.

In the burn-off zone of the sintering furnace, lubricants and/or waxes are removed from the bodies to be sintered by being burned off at temperatures that can typically be between 500° C. and 800° C. After having passed the burn-off zone, the bodies to be sintered pass into the sintering zone, in which the sintering process takes place at temperatures that are typically approximately in a range between 80 percent and 95 percent of the absolute melting temperature expressed in Kelvin of the material to be sintered. At these temperatures a reduction of the oxides in the bodies takes place at first. In this stage, the sintering of the bodies already occurs largely simultaneously. After the bodies pass through the sintering zone, the bodies arrive in a typically still present cooling-off zone, in which the bodies, now already sintered, can cool off before they can subsequently be optionally subjected to one or more post-treatments such as, for example, thermal post-treatments. The cooling-off zone can also be used, for example, in order to be able to carry out a thermal post-treatment of the sintered bodies in it. The aforementioned zones can be arranged one directly behind the other, or else separated from each other by additional zones disposed between the respective zones. For example, it can be provided that a transitional zone is disposed between the burn-off zone and the sintering zone. This transitional zone, in terms of it structure, can be characterized, for example, in that it can have a modified cross section in contrast to the adjacent zones, such as the burn-off zone and/or the sintering zone. In many cases, the transitional zone has a cross section that is narrowed in comparison to the burn-off zone and also to the sintering zone. However, a cross section that is unmodified in comparison to one or both of the adjacent zones can also be provided. However, it can also be possible that the transitional zone differs from the zones adjacent to the transitional zone by other parameters. For example, it can be provided that the transitional zone is an area with conditions that differ from the conditions prevailing in the adjacent zones, in which, for example, a temperature and/or an atmosphere prevails and/or a wall lining is disposed on the sintering furnace different from those in one or more of the adjacent zones.

One concept of the invention provides a method with which gases are removed from a sintering furnace. The method provides that gas flowing between a first zone of the sintering furnace and a second zone of the sintering furnace passes a transitional zone disposed between the first zone and the second zone. During passage through the transitional zone, at least a portion of the gas flowing from one of the two zones in the direction of the other of the two zones arrives at least in an area of the transitional zone through at least one gas removal device opening into at least one gas removal device and is then removed from the sintering furnace by the gas removal device. The term gas in this case can also comprise, in addition to substances present in a gaseous aggregate state, particles dispersed in such substances, which particles are distributed in the gaseous phase, for example, during the burn-off process.

In one embodiment of the method, the cooler of the two gasses flows under the warmer of the two gases as a result of natural convection. At least a portion of the cooler of the two gases enters at the level of the transporting surface and/or below the level of the transporting surface into the gas removal device opening. The advantage of the cooler of the two gases entering the gas removal device opening at the level of a transporting surface and/or below this level can be, for example, that a removal of the cooler of the two gases from the sintering furnace is made possible just on the basis of natural convection. In one exemplary embodiment of the first zone as a burn-off zone and of the second zone as a sintering zone, the method is based on the operating principle that, due to the higher temperatures prevailing in general in one area of the sintering zone as compared to the burn-off zone, a large portion of sintering zone gas flowing through the sintering zone is heated at higher temperatures than a significant portion of burn-off zone gas after it has flowed through the burn-off zone. Thus, the result of such an exemplary design is that at least a portion of the burn-off zone gas enters the gas removal device opening at the level of the transporting surface and/or below the level of the transporting surface. The term sintering zone gas refers in this case to the gas as a whole located in the sintering zone and flowing out of the sintering zone. The term gas and the term sintering zone gas in this case can also comprise, in addition to substances in a gaseous aggregate state, particles dispersed in such substances, and which are distributed in the gas phase, for example, during the sintering process.

An advantage of the described removal of burn-off gas from the sintering furnace by the gas removal device, is that contaminants caused by burn-off gas pass into the sintering zone to a lesser extent than would be the case without a removal of burn-off zone gas. Given a sufficient level of the portion of burn-off gas removed from the sintering furnace, other measures for reducing the contaminants present in the sintering zone are therefore less necessary. For example, the volume flow of protective gas admitted into the sintering furnace at the sintering zone outlet can be reduced, in order to flow from there in the direction of the burn-off zone and to reduce an inflow of burn-off zone gas into the sintering zone. The use of locks in an area between the burn-off zone and the sintering zone can also be eliminated, the advantage of which is that time-consuming delays caused by using locks can be avoided. The same advantage results from a corresponding usage of the described method in transitional zones between zones other than the burn-off zone and the sintering zone, for example, between the sintering zone and the carburization zone.

In another embodiment of the first and of the second zone, the same advantage of a reduction of the amount of contaminants that move from one zone into another zone would result.

In another embodiment of the method, it is provided that as a consequence of natural convection the cooler of the two gases flows below the warmer of the two gases, and that at least a portion of the warmer of the two gasses enters at the level of the transporting surface and/or above the level of the transporting surface into the gas removal opening.

According to another embodiment of the invention, it is provided that at least the portion of the gas flowing from one of the two zones in the direction of the other of the two zones passes through the gas removal device opening into the gas removal device as a result of natural convection, and, as a further result of natural convection, is removed from the sintering furnace by the gas removal device. To this end, the course of the gas removal device is shaped in such a manner that a cooler gas of two gases is conducted substantially downwardly and a warmer gas of two gases is conducted substantially upwardly out of the sintering furnace. This can contribute significantly to the conduction of the gas or the gases out of the sintering furnace as a result of the natural convection caused by the existing gas temperatures, and consequently additional means for forcing convection can be largely or even totally eliminated. The advantage of such a method is that no acceleration of the gas by devices appropriately provided to this end such as, for example, compressors, is necessary. This results, for example, in the advantage that given the possibility of eliminating other devices such as, for example, compressors, disadvantages caused by them can be avoided. For example, an elimination of compressors or at least the possibility of using a lesser number of compressors reduces or even entirely avoids turbulences arising from gases present in the sintering furnace, as a result of which, for example, it is possible to prevent a passing of gases from one zone into another zone, for example, from the first zone into the second zone and/or from the second zone into the first zone, from occurring to an undesired extent.

According to another embodiment of the invention, it is provided that the gas flowing between the first and the second zone flows at least partially past at least one cross-section-narrowing body, and as a result the direction of flow is changed in the direction of the gas removal device opening. It can be provided here, for example, that the one cross-section-narrowing body is designed as an aggregate of lamellas.

In another embodiment of the method, it is provided that the portion of the gas flowing from one of the two zones in the direction of the other of the two zones is accelerated in the direction of the gas removal device by protective gas introduced in an area of the transitional zone substantially opposite the gas removal device, and is changed, preferably adjusted, especially preferably regulated as a result. For example, upon introduction of the protective gas under comparatively high pressure, which exhibits a high kinetic energy as a result of being introduced under high pressure, gases passing from the adjacent zones into the area of the transitional zone would be accelerated in the direction of the gas removal device opening. The resulting movement component is overlaid here with already existing movement components, such as those existing, for example, as the result of natural convection.

In one embodiment of the method, it is provided that the volume flow of gas removed by the gas removal device and, as a result, the level of the portion of the gas removed by the gas removal device flowing from one of the two zones in the direction of the other of the two zones, is adjusted, preferably regulated with the aid of at least one flow-through change component disposed inside the gas removal device. As a result, the level of the removed amount of the gas flowing from the first zone in the direction of the second zone can be regulated with the aid of a flow-through change component in accordance with the existing process parameters, for example, based on the prevailing or adjusted temperatures. One advantage of such a method, for example, when the first zone is designed as a burn-off zone and the second zone as a sintering zone, " is that in the case of simultaneous, potentially undesirable, removal of sintering zone gas with the burn-off zone gas or, for example, with the occurrence of equally undesirable turbulences or in the case of other undesirable, for example, dynamic flow effects, the degree thereof may be reduced or avoided by a change, in particular a reduction, of the volume flow of the gas removed by convection into the gas removal device.

In another embodiment of the method, it can be provided that the volume flow of gas removed by the gas removal device and, as a result, the level of the portion of gas flowing from one of the two zones in the direction of the other of the two zones is adjusted, preferably increased, especially preferably regulated with the aid of at least one convection-forcing device disposed inside the gas removal device.

In one embodiment of the method, it can be provided that an adjustment of the level of the portion of the gas flowing from one of the two zones in the direction of the other of the two zones takes place as a regulating carried out with the aid of a regulating circuit. This regulating circuit can, for example, effect a change in the volume flow after measuring process parameters. For example, the portion of gas removed by the gas removal device flowing between the first zone and the second zone can be changed with the aid of a flow-through change component and/or a convection-forcing device.

In one embodiment of the method, it can be provided that a sensor for measuring the dew point temperature of vapor present in the sintering furnace is in the regulating circuit for regulating the level of the removed amount of the burn-off zone gas as at least one measuring component. This preferably concerns the dew point temperature of water vapor. For example, a dew point mirror hygrometer can be used. It is especially advantageous here if the sensor for measuring the dew point temperature is disposed inside a zone, in which an inflow of gases from adjacent zones is to be avoided with the aid of the gas removal device. For example, if the first zone were designed as a burn-off zone and the second zone as sintering zone, the sensor for measuring the dew point temperature would preferably be disposed within the sintering zone.

One advantage of such a method is, for example, the fact that a possibly undesirably high concentration of undesirable gas constituents and/or dispersed constituents stemming originally from one of the two zones can be measured with moderate measuring technology-related effort. When exceeding a limit value, above which a deterioration of the sintered components is to be expected, the level of the portion of the gas conducted through the gas removal device can be increased at this point by guiding the flow-through change component at least partially out of the cross section of the gas removal device and/or by increasing the volume flow conducted through the gas removal device away from the gas removal device opening with the aid of the convection-forcing device. In the example in which the first zone is designed as a burn-off zone and the second zone as a sintering zone it is possible, for example, to prevent a significant reduction in an undesirably high concentration of undesirable substances passed into the burn-off atmosphere during the burn-off process and transported with the burn off zone gas and/or as constituents of the burn-off zone gas into the sintering zone.

Another embodiment of the method is provided, during which at least the portion of the gas removed by the gas removal device flowing out of one of the two zones in the direction of the other of the two zones, is conducted into a heat exchanger, in which fluid is heated by the transfer of thermal energy from the portion of the gas removed.

Another embodiment of the method is provided, during which at least the portion of the gas removed by the gas removal device flowing out of one of the two zones in the direction of the other of the two zones, is conducted into a heat exchanger. In the heat exchanger, thermal energy of the warm gas is used to heat protective gas to be conducted into the sintering furnace by transferring thermal energy. The advantage of heating protective gas to be conducted into the sintering furnace before its introduction into the sintering furnace, is that it is possible to reduce the thermal output to be applied in the sintering zone for maintaining the temperature prevailing in an area of the sintering furnace in which the protective gas is introduced. An example for the introduction of protective gas into the sintering furnace is the introduction of protective gas in an area of the sintering zone. If protective gas already pre-heated is introduced in one area of the sintering zone, at least the thermal output required to maintain the sintering temperature in one area of the sintering zone is reduced.

The heat exchanger can be, for example, a recuperator, which can be implemented, for example, in direct-current design, cross-current design, counter-current design and/or core-current design or in combinations thereof.

In one embodiment of the method, it is provided that the first zone is the burn-off zone and the second zone is the sintering zone. There is an advantage in using this embodiment of the method, since components of the bodies to be sintered outgas in the burn-off zone in accordance with the purpose of the burn-off zone. Moreover, combustion products such as, for example, CO, $CO_2$, $H_2O$ and/or carbon blacks are formed in the burn-off zone, which may form, for example, during the combustion of auxiliary pressing agents present in the blanks and/or in the combustion of the fuel gas. One or more of these components entering into the sintering zone can cause undesirable processes at the typically high temperatures prevailing in the sintering zone such as, for example, the formation of reaction products from the previously outgassed components and from the surface of the bodies to be sintered, and/or a diffusion of the previously outgassed components into the volume of the body to be sintered.

It is provided, in particular, that the described sintering furnace and/or the described method for producing non-oxidative sintered bodies is used. The advantage here is that the portion of burn-off gas in the sintering zone is reduced as a result of a removal of the gas flowing from the first zone, for example, from the burn-off zone in the direction of the second zone, for example, the sintering zone, by the gas removal device. In the example of the first zone designed as burn-off zone and of the second zone as sintering zone, the resulting advantage, for example, is that outgassings separated and/or produced during the burning off are therefore partially or even largely removed from the transitional zone by the gas removal device, depending on the adjustment and depending on the regulation, and thus are only slightly, or barely or, in the optimum case, no longer able at all to pass into the sintering zone. As a result, the sintered bodies that tend to react with such parts, in particular non-oxidic parts, can be produced with a resulting high quality such as, for example, a high surface quality.

Additional embodiments of the inventions are explained in detail below with reference made to the figures in detail. The figures and accompanying descriptions of the resulting features are not limited to the respective embodiments, but serve to illustrate an exemplary embodiment. Furthermore, the respective features can be used with one another as well as with features of the above description for possible further developments and improvements of the invention, especially in additional embodiments that are not shown in detail here.

Figure 1B:
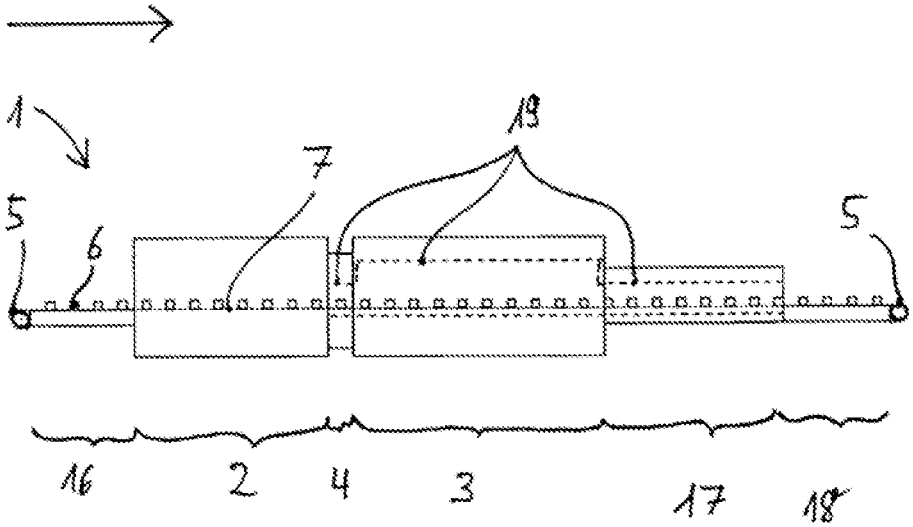
Prior Art Fig. 1b
Figure 2A:
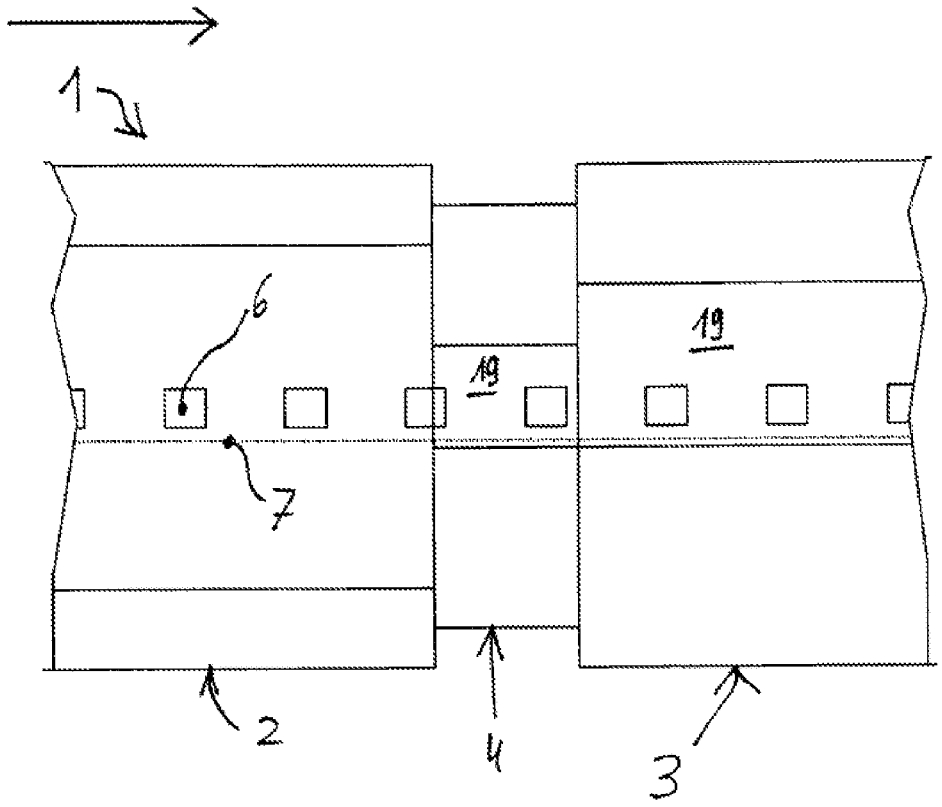
Prior Art Fig. 2a
Figure 2B:
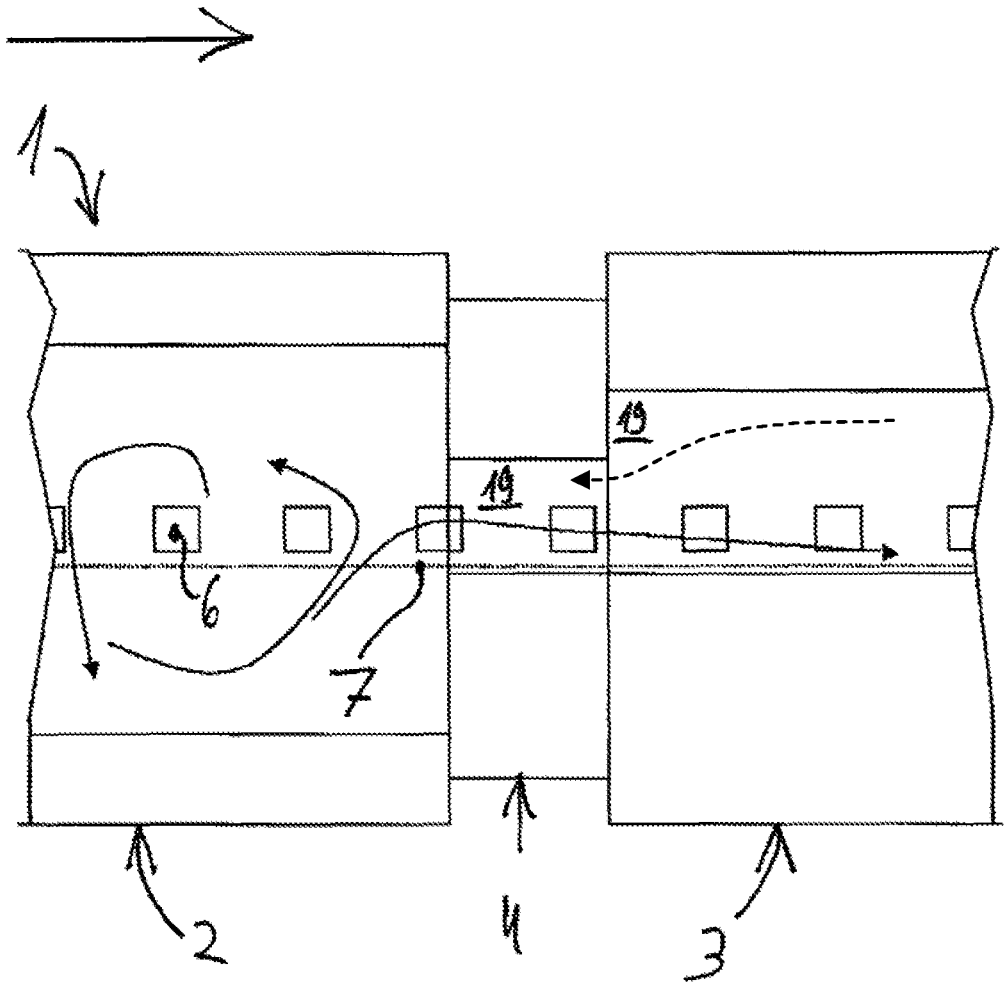
Figure 3A:
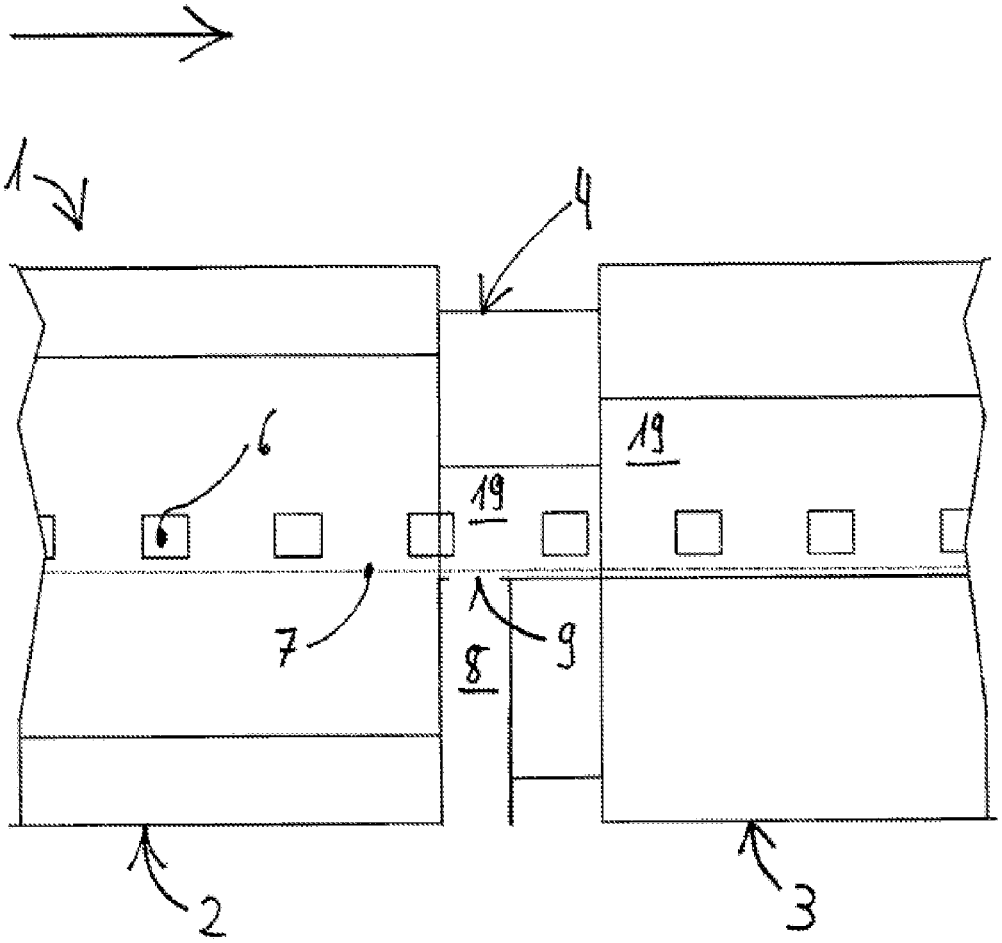
Figure 3B:
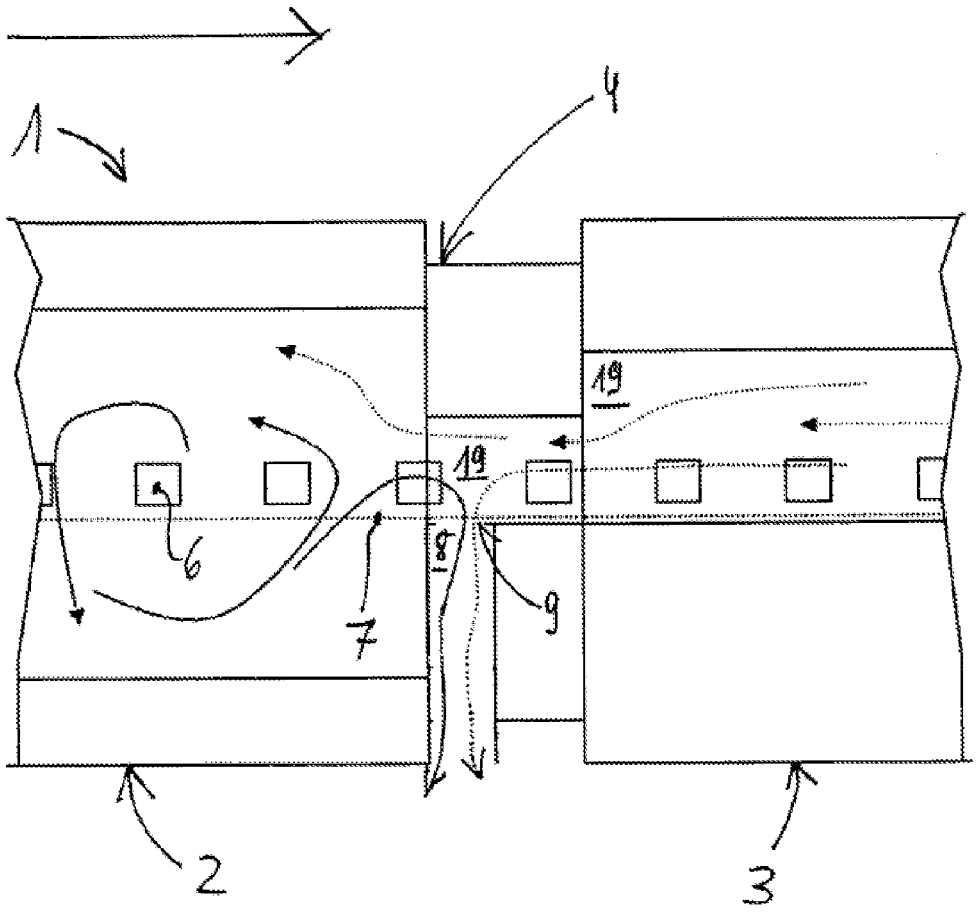
Figure 3C:
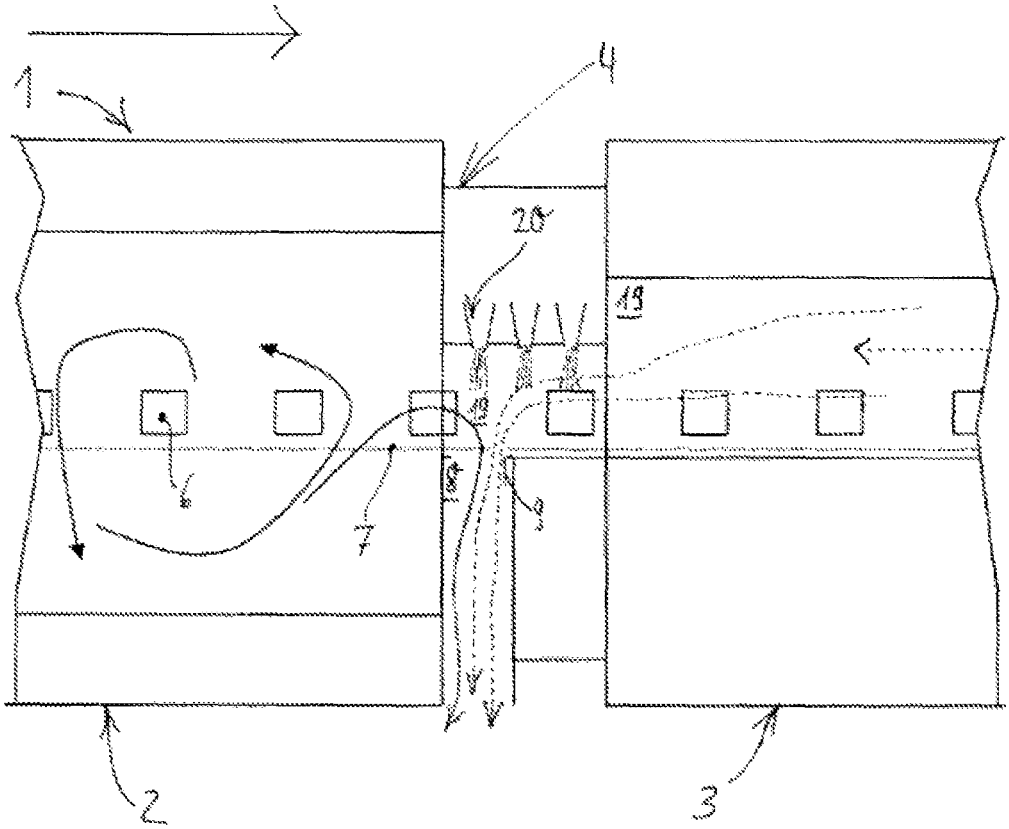
Figure 3D:
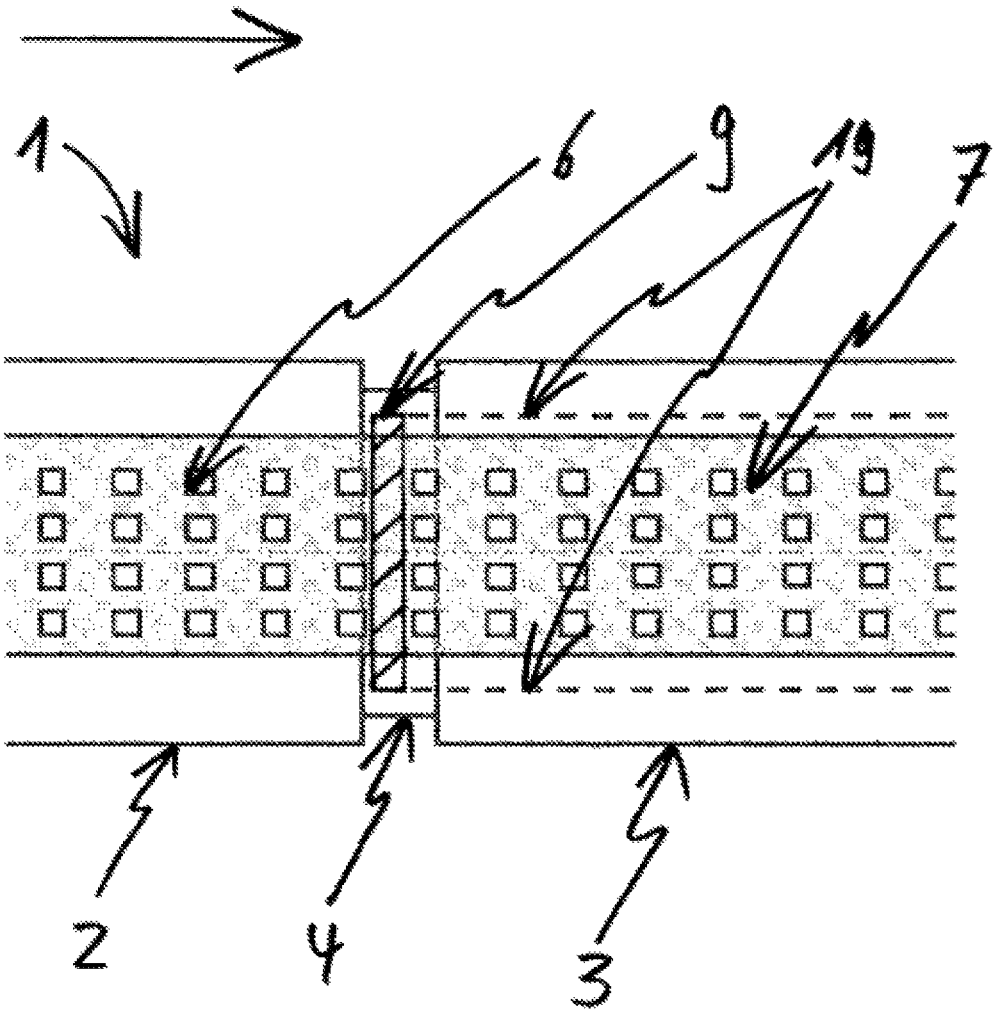
Figure 3E:
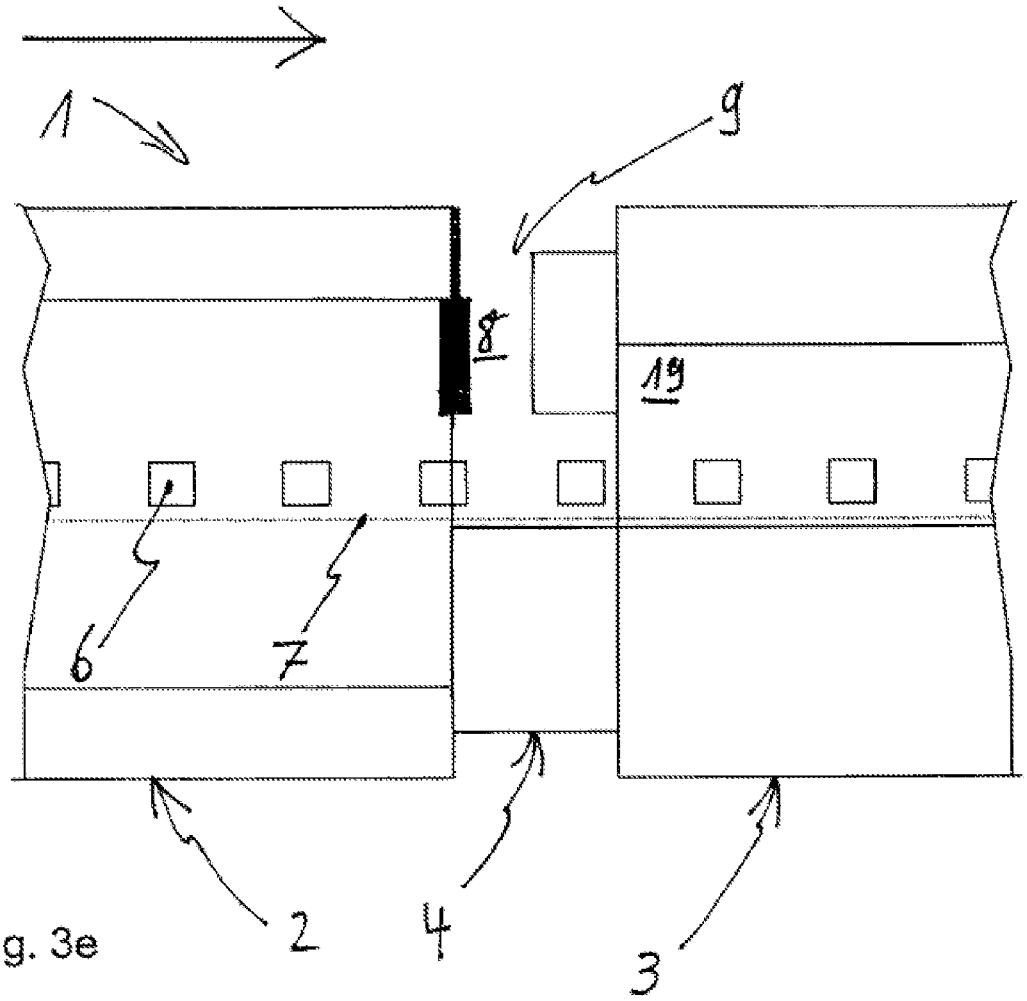
Figure 3:
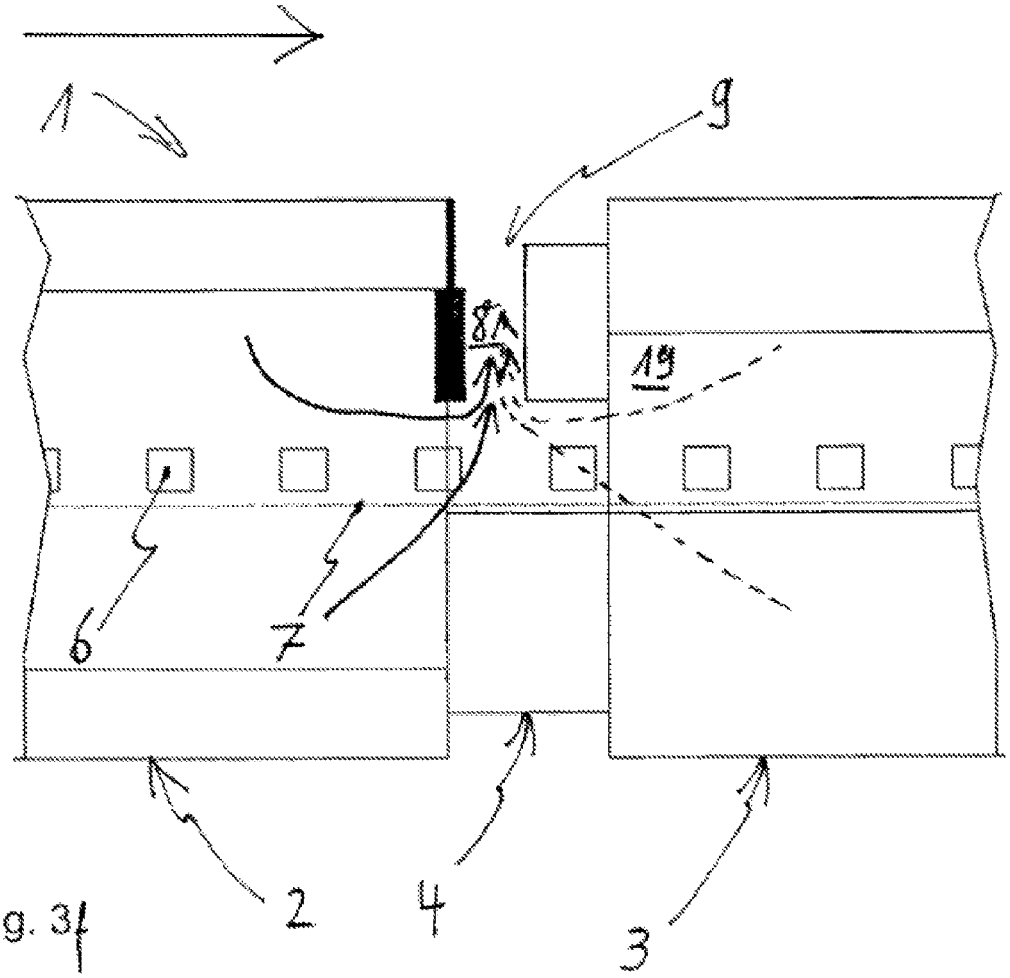
Figure 4A:
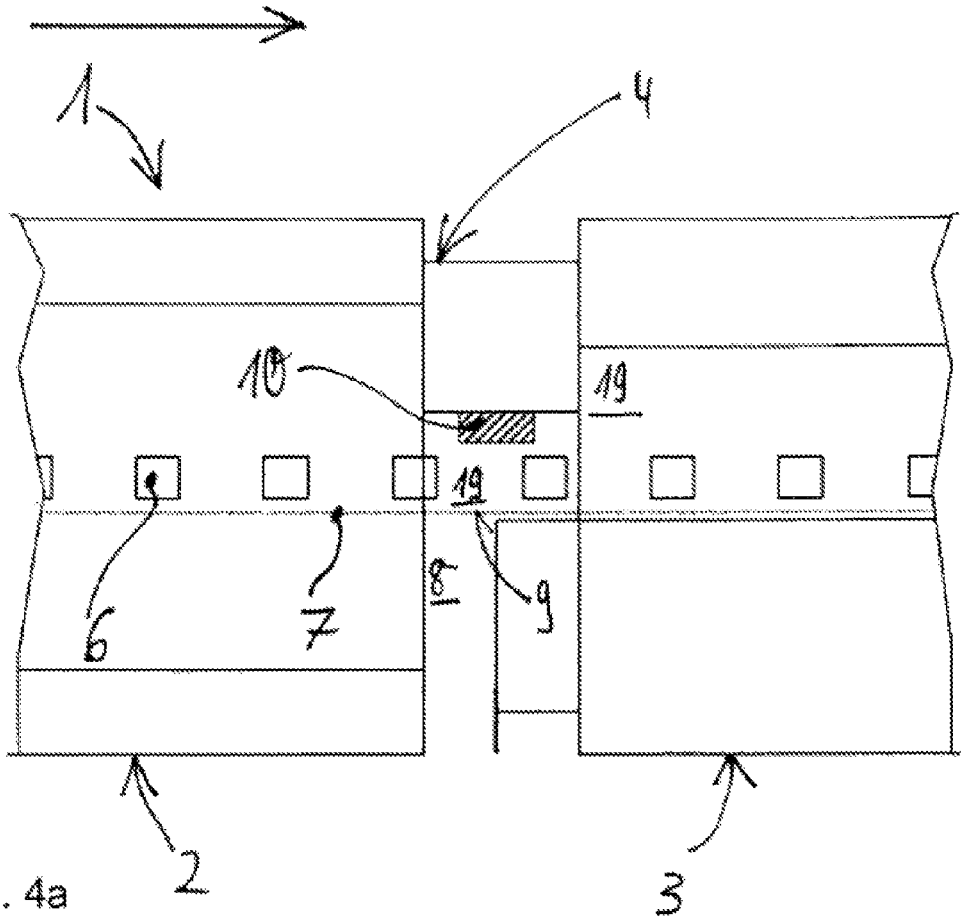
Figure 4B:
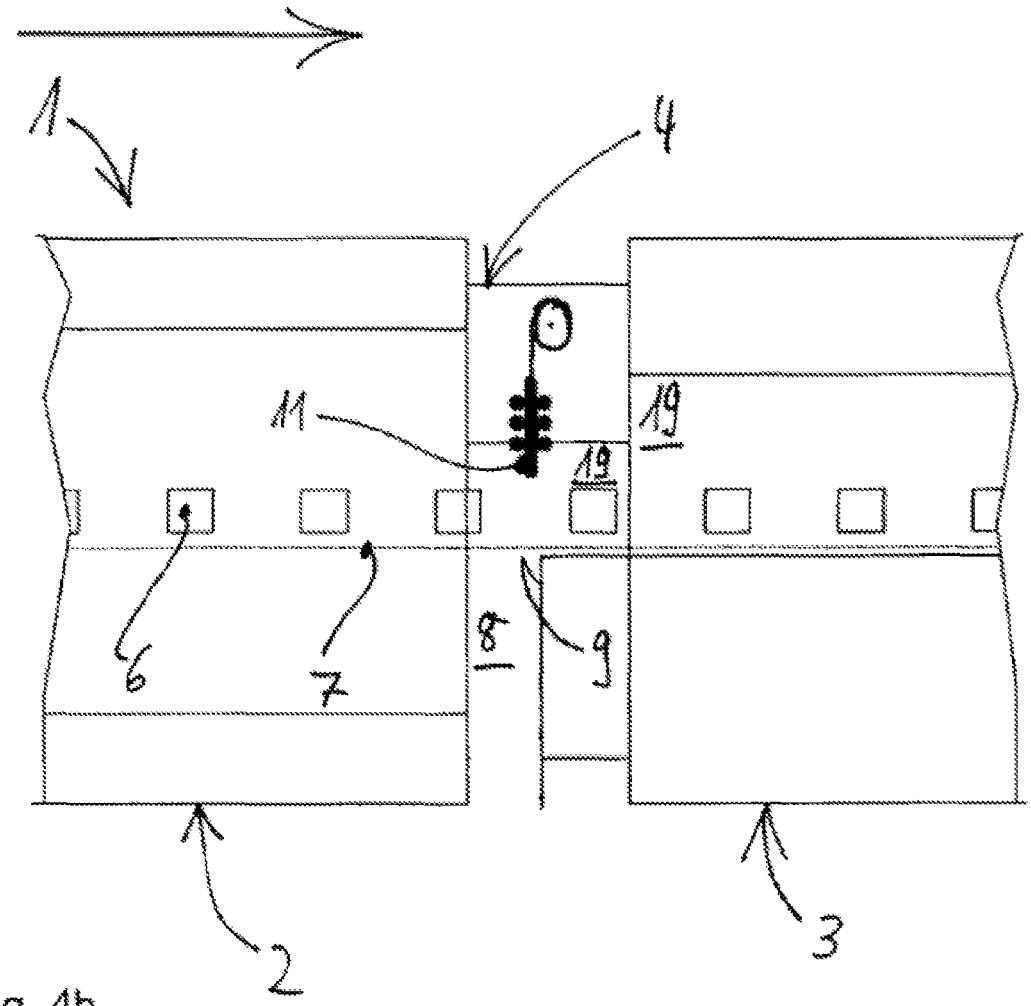
Figure 4C:
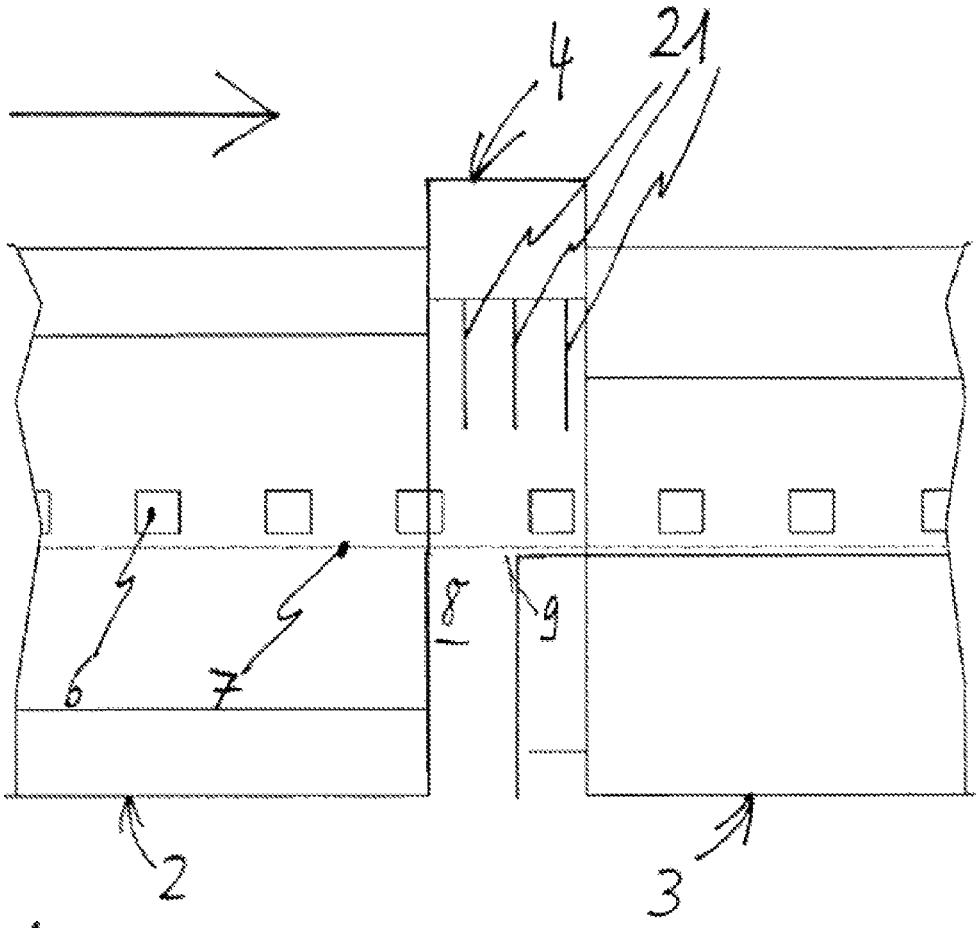
Figure 4D:
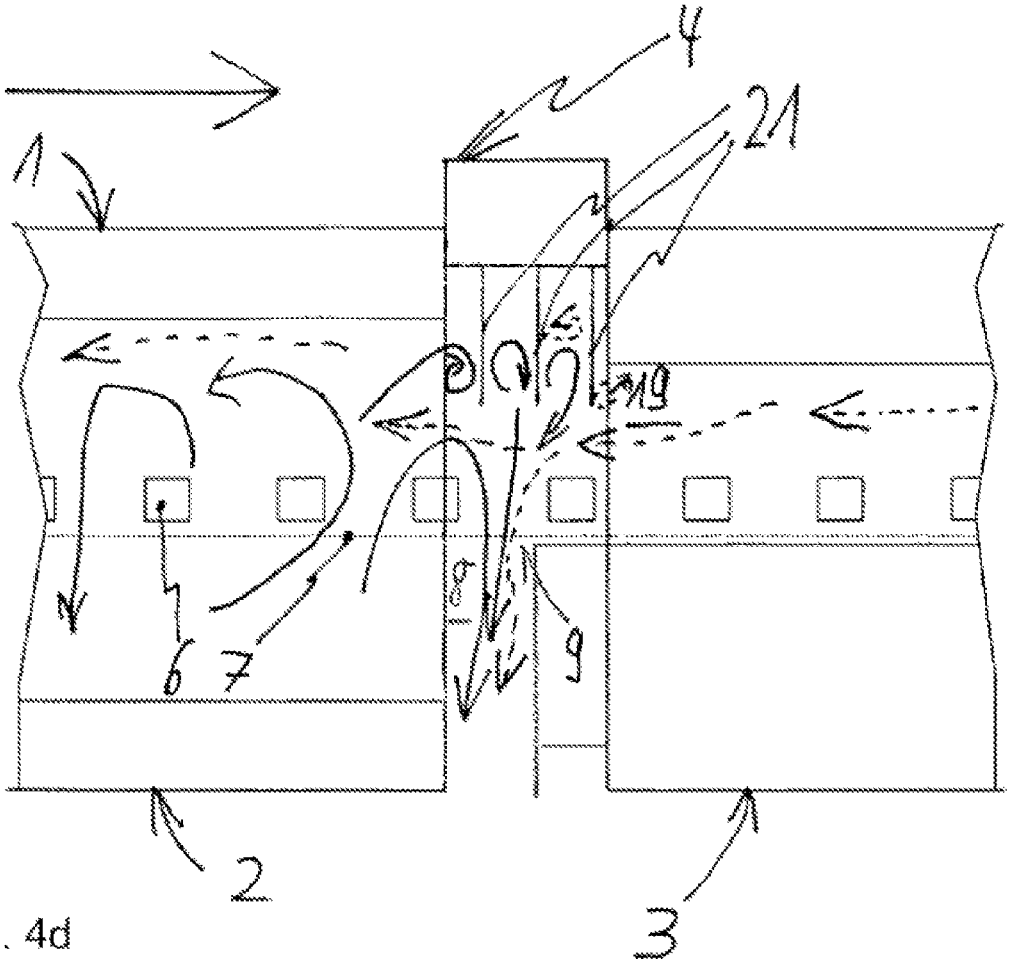
Figure 4E:
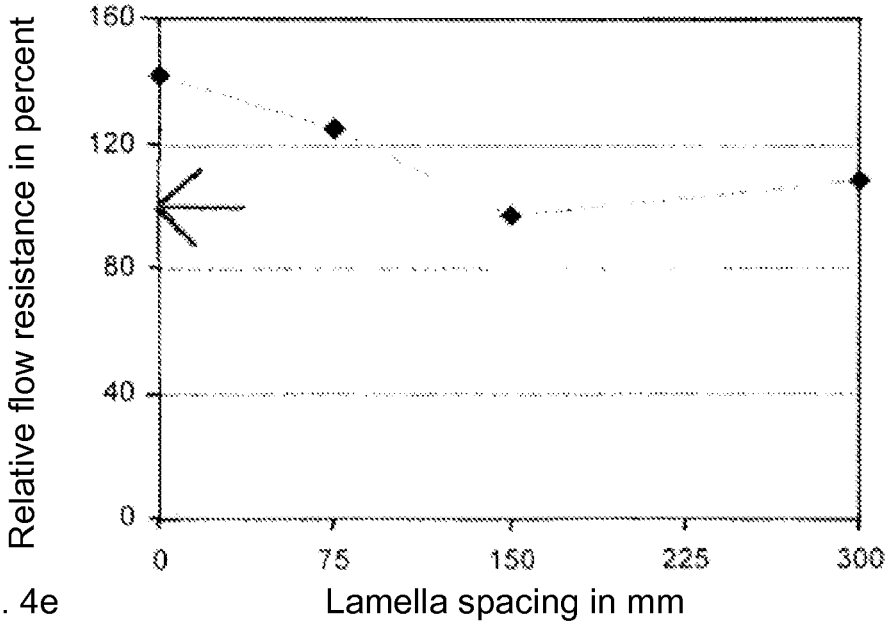
Figure 4F:
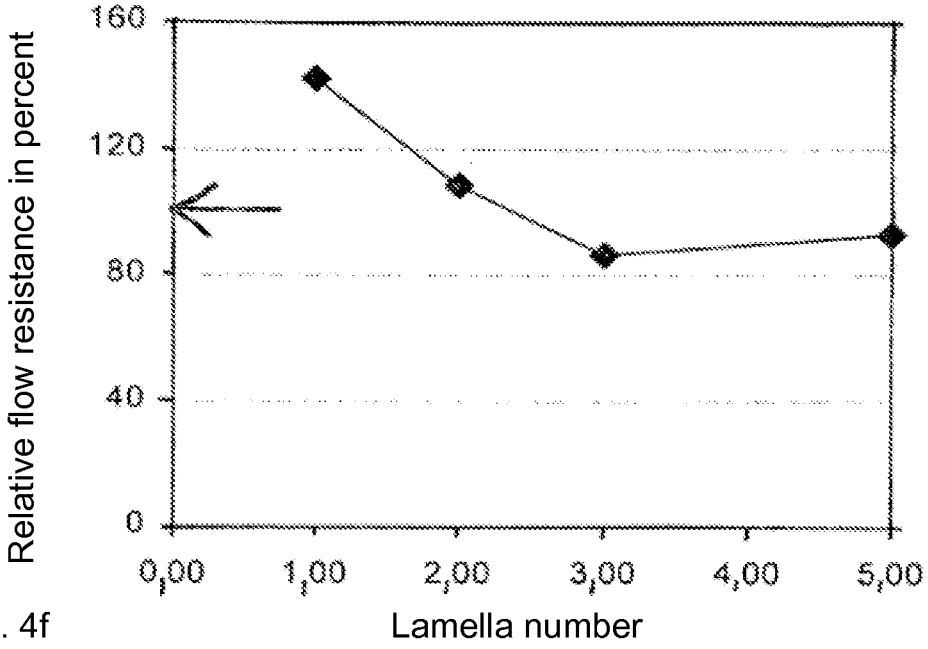
Figure 5A:
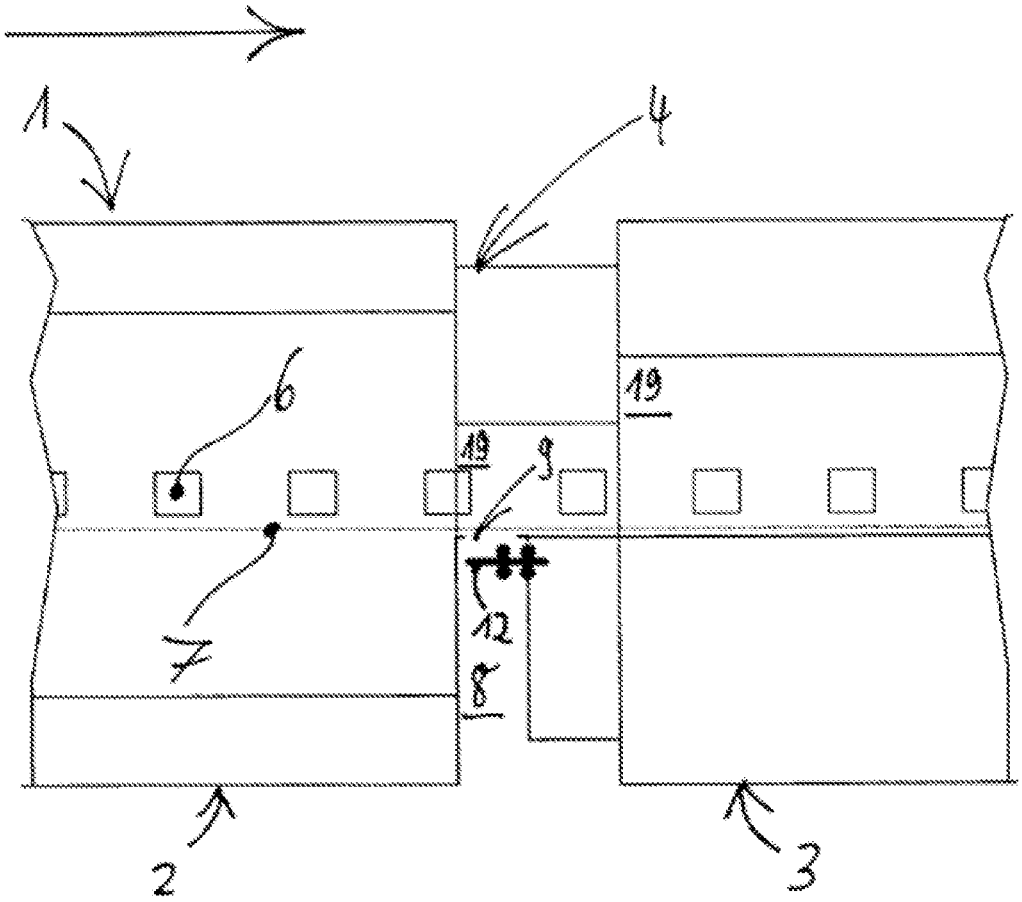
Figure 5B:
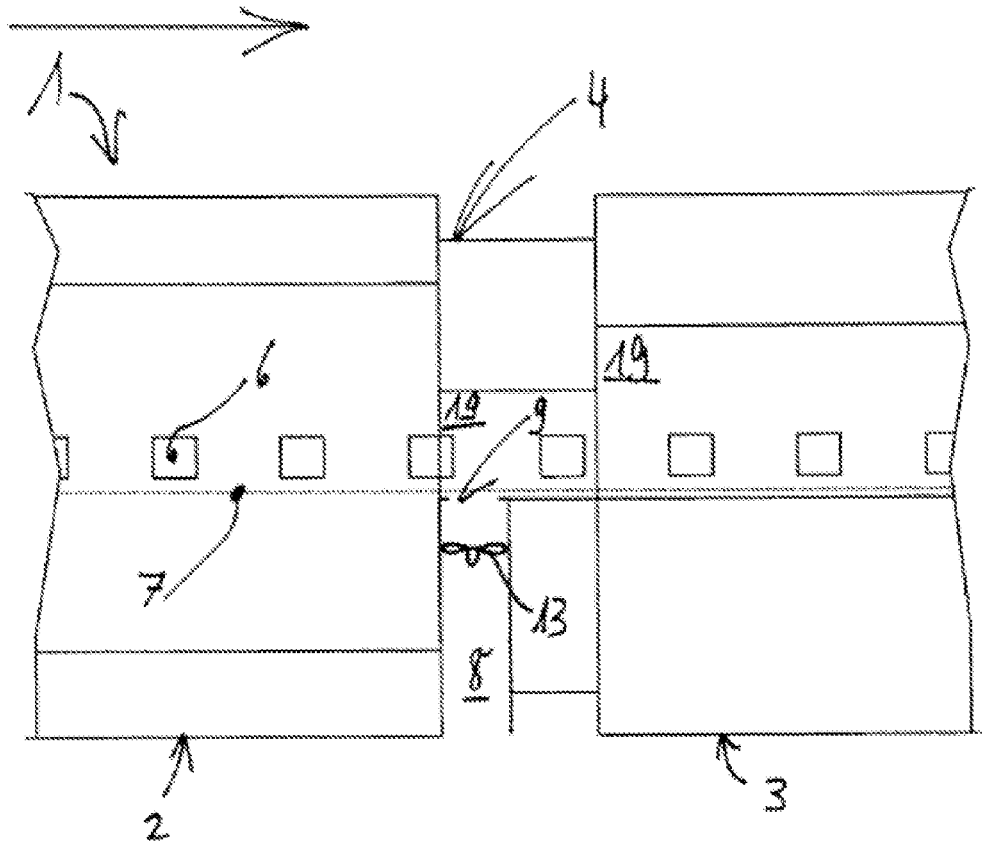
Figure 5C:
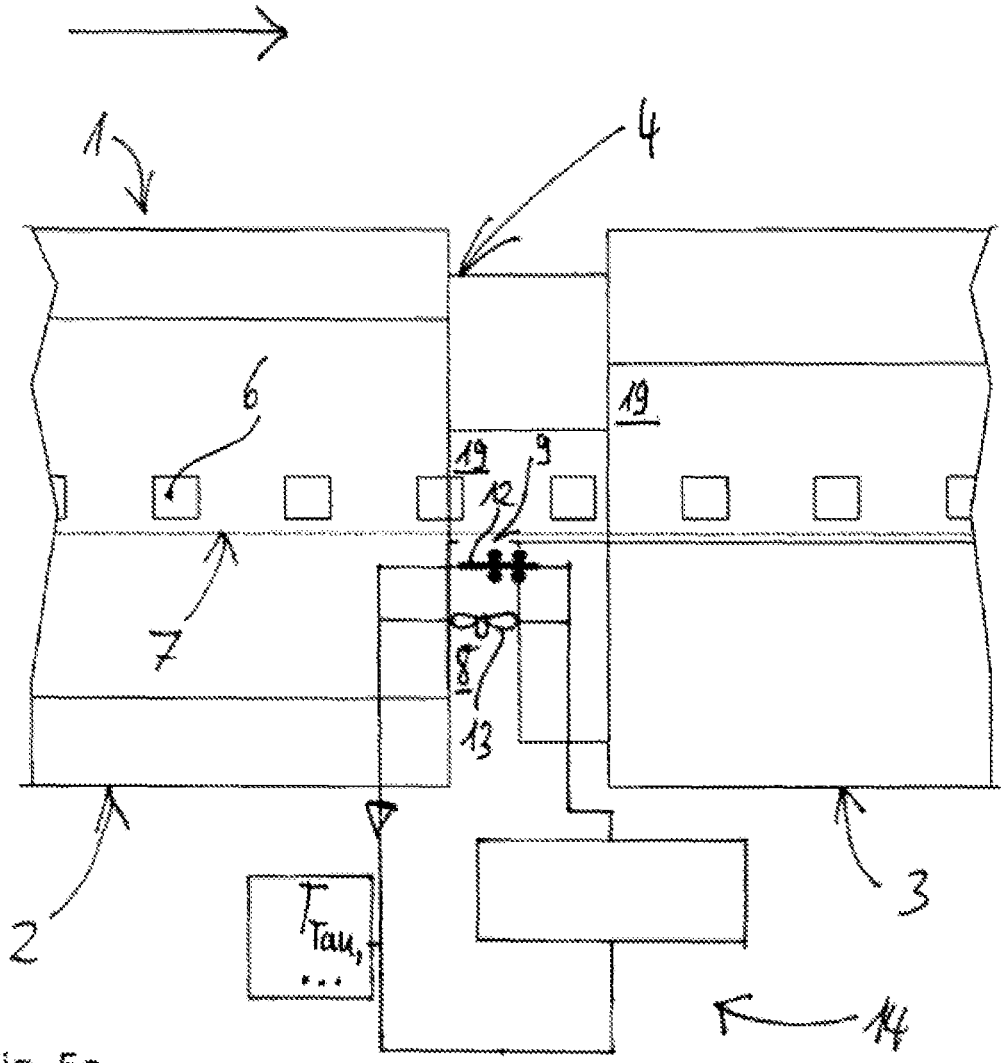
Figure 6:
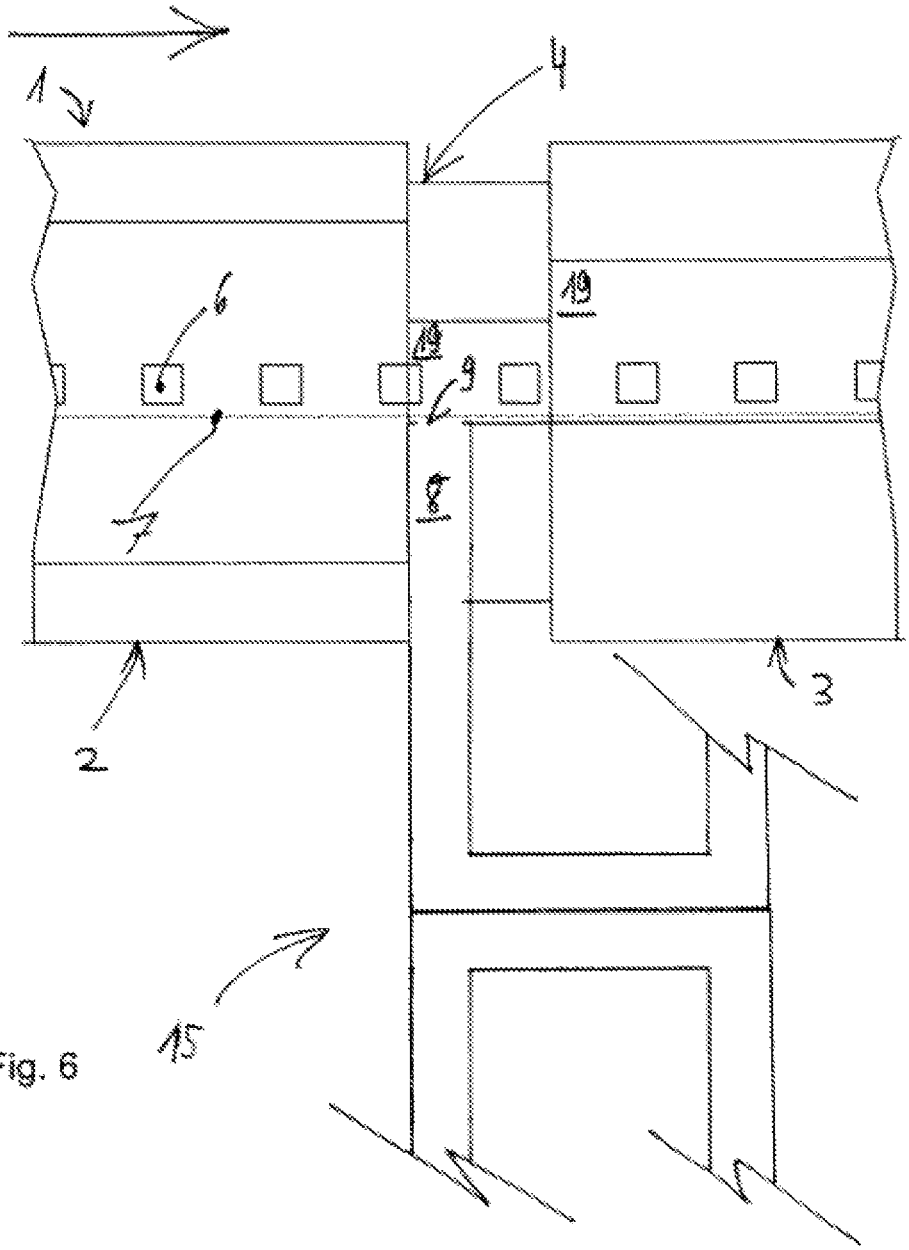

In the following:

| | |
|---|---|
| FIG. 1a: | Shows a sintering furnace embodied as a sintering belt furnace according to the prior art in a top view, |
| FIG. 1b: | Shows a sintering furnace embodied as a sintering belt furnace according to the prior art in a side view, |
| FIG. 2a: | Shows a section of a sintering furnace embodied as a sintering belt furnace according to the prior art in a side view, |
| FIG. 2b: | Shows a schematic representation of a flow prevailing in the sintering furnace shown in FIG. 2a during its operation in a side view, |
| FIG. 3a: | Shows a section of a sintering furnace embodied as a sintering belt furnace with a gas removal device disposed in one area of the transitional zone in a side view, |
| FIG. 3b: | Shows a schematic representation of a flow prevailing in the section of a sintering furnace shown in FIG. 3a during its operation in a side view, |
| FIG. 3c: | Shows a schematic representation of another embodiment of the sintering furnace in a side view, |
| FIG. 3d: | Shows a schematic representation of a section of a sintering furnace with a gas removal device disposed in a transitional zone in a top view, |
| FIG. 3e: | Shows a section of a sintering furnace embodied as a sintering belt furnace with a gas removal device disposed in one area of the transitional zone in a side view in another embodiment, |
| FIG. 3f: | Shows a schematic representation of prevailing flow in the section of asintering furnace shown in FIG. 3e during its operation in a side view, |
| FIG. 4a-FIG. 4d: | Show sections of other embodiments of a sintering furnace in a side view, |
| FIG. 4e-FIG. 4f: | Show diagrams for representing the relative flow resistance of a cross-section-narrowing body designed as an aggregate of lamellas. |
| FIG. 5a-FIG. 5c: | Show sections of other embodiments of a sintering furnace in a side view, |
| FIG. 6: | Shows a section of a sintering furnace embodied as a sintering belt furnace with a heat exchanger connected downstream from the gas removal device in a side view. |

FIG. 1*a* shows a top view of a sintering furnace 1 embodied as a sintering band furnace according to the prior art. The sintering furnace 1, in the direction of the provided transport direction indicated by the arrow, comprises a furnace inlet 16, a first zone 2 designed as a burn-off zone, a transitional zone 4, a second zone 3 designed as a sintering zone, a cooling zone 17 and a sintering furnace outlet 18. Bodies 6 to be sintered are located on the transporting surface 7, which is designed as a sintering belt in the sintering furnace 1 shown. Also disposed on both sides of the transporting surface 7 in the sintering furnace 1 shown is, in each case, a muffle wall 19, which extends parallel to the limiting lines of the transporting surface 7 of the sintering furnace 1 from the beginning of the transitional zone 4 along the sintering zone 3 to the end of the cooling zone 17, as viewed in the transport direction provided.

FIG. 1*b* shows a side view of a sintering furnace 1 embodied as a sintering belt furnace according to the prior art. The features cited in the description for FIG. 1 *a* can also be found in FIG. 1*b*, so that for terms, reference is made to the description of FIG. 1 *a*. Also shown in a side view at the ends of the transporting surface 7 is a transporting mechanism 5, which is designed as a sintering belt roller disposed at the end of the transporting belt. Furthermore, FIG. 1*b* shows a possible embodiment of the muffle wall 19, the height of which can differ in the three zones of its longitudinal extension, transitional zone 4, sintering zone 3 and cooling zone 17.

FIG. 2*a* shows a side view of a section of a sintering furnace 1 embodied as a sintering belt furnace according to the prior art. The drawing shows areas of the burn-off zone 2 and of the sintering zone 3 and a transitional zone 4 disposed between these two zones. Bodies 6 to be sintered are situated on the transporting surface 7 in order to be transported on it in the transport direction indicated by the arrow. Muffle walls 19 are disposed around the transporting surface 7 along the longitudinal extension of the transitional zone 4 and along the visible longitudinal extension of the sintering zone 3.

FIG. 2*b* shows with arrows how, based on experiments conducted, the gas essentially flows inside the sintering furnace 1 in the embodiment shown in FIG. 2*a* during its operation. The reference numerals in FIG. 2*b* are the same as those in FIG. 2*a*. The dotted arrow in FIG. 2*b* indicates the direction of flow of sintering zone gas stemming from the area of the sintering zone 3. This sintering zone gas is permanently introduced as protective gas in one area of the transition between the sintering zone and the cooling zone. The solid arrows indicate directions of flow of burn-off zone gas in one area of the burn-off zone 2 and stemming from the area of the burn-off zone 2 flowing in the direction of the sintering zone 3. It is especially apparent that sintering zone gas flowing from the area of the sintering zone 3 into the area of the burn-off zone 2 is underflowed in an approximately wedge-shaped manner by burn-off zone gas flowing from the area of the burn-off zone 2 into the area of the sintering zone due to convection. In addition, circulatory movements of burn-off zone gas also take place that flow through the transporting surface 7, since in the embodiment shown the transporting surface is designed as an at least partially gas-permeable conveyor belt.

The Table 1 below shows a tabular listing of measured data ascertained for a sintering furnace in an embodiment according to FIG. 2*a* with no gas removal device disposed in an area of the transporting surface, wherein the longitudinal extension of the sintering zone and of the cooling zone in the direction of transport was in each case 6 m during the experiments carried out. A corresponding gas inlet was disposed in an area between the sintering zone and the cooling zone as an inlet for admitting protective gas into the sintering furnace. In the tabular fields that have two values, the upper values refer to results that were determined while burners located in the burn-off zone were turned off, whereas the lower values refer to results during which burners located in the burn-off zone were turned on and therefore resulted in the heating of the burn-off zone gas as well as to the addition of fuel gases and dispersoids stemming from the burners to the burn-off zone gas. The fields in which only one value is entered refer to results determined without burners turned on in the burn-off zone. The temperatures indicated are measured values measured in the sintering furnace, whereas the volume flows and the mass flows are results determined according to simulation calculations. The assumption was made for the simulation calculations that the amount of protective gas flowing through the sintering zone in the direction of the burn-off zone is identical to the amount of protective gas flowing through the cooling zone in the direction pointing away from the burn-off zone, starting from the gas inlet. The indicated values for pressure difference and speed are also results obtained by simulation calculations using experimentally measured flow resistances in individual zones of the sintering furnace. The plausibility of the values determined by simulation calculations for the pressure difference and speed could be corroborated by comparison experiments carried out with a real sintering furnace under operating conditions.

TABLE 1

Values determined for a sintering furnace according to FIG. 2a and therefore with no gas removal device

| | Burner | Furnace inlet | Burn-off zone | Transitional zone | Sintering zone 6 m gas inlet at the end | Cooling zone 6 m | Furnace outlet with curtains |
|---|---|---|---|---|---|---|---|
| Average gas temperature (° C.) | off | 700 | 700 | 1050 | 700 | 550 | 50 |
| | on | 700 | 700 | 1050 | 700 | 550 | 50 |
| Mass flow (kg/s) | off | 0.0115 | 0.0115 | 0.0115 | 0.0115 | 0.0085 | 0.0085 |
| | on | 0.0245 | 0.0245 | 0.0065 | 0.0065 | 0.0135 | 0.0135 |
| Volume flow ($m^3/s$) | off | 0.032 | 0.032 | 0.043 | 0.032 | 0.020 | 0.008 |
| | on | 0.068 | 0.068 | 0.025 | 0.018 | 0.032 | 0.012 |
| Cross section ($m^2$) | | 0.072 | 0.500 | 0.072 | 0.126 | 0.072 | 0.072 |
| Speed (m/s) | off | 0.442 | 0.064 | 0.601 | 0.253 | 0.276 | 0.108 |
| | on | 0.943 | 0.136 | 0.341 | 0.143 | 0.438 | 0.172 |
| Density ($kg/m^3$) | off | 0.361 | 0.136 | 0.266 | 0.361 | 0.427 | 1.089 |
| | on | 0.361 | 0.361 | 0.266 | 0.361 | 0.427 | 1.089 |
| Ceta (–) | off | 2.99 | 0 | 1.87 | 0.72 | 0.72 | 30 |
| | on | 2.99 | 0 | 1.87 | 0.72 | 0.72 | 30 |
| Pressure difference (Pa) | off | 0.106 | 0.000 | 0.090 | 0.008 | 0.012 | 0.192 |
| | on | 0.480 | 0.000 | 0.029 | 0.003 | 0.029 | 0.482 |
| Total pressure difference (Pa) | off | | 0.204 | | | 0.204 | |
| | on | | 0.512 | | | 0.512 | |

The experimentally determined average gas temperatures were measured as input values in a range of the furnace inlet, within the burn-off zone, within the transitional zone, within the sintering zone, which had a length of 6 m in the furnace used, within the cooling zone, which also had a length of 6 m and in one area of the furnace outlet. The average temperature in this case was calculated as the arithmetic average value from temperature values determined along a largely complete longitudinal extension of each zone. The indicated temperatures in this case are the average gas temperatures measured with thermometers shielded specifically from radiated heat. As Table 1 shows, gas inside the burn-off zone in the sintering furnace had an average temperature of 700° C., while in an area of the transitional zone between the burn-off zone and the sintering zone the average temperature of gas in the sintering furnace was raised to 1050° C. Based on these conditions, on the temperature profile cited in the line "average gas temperature/° C." and on the pressure loss coefficient indicated in the line "Ceta" as the pressure loss when flowing through the respective zone, with the cross sections of the sintering furnace indicated in the line "Cross section/m2, values for the mass flow, the volume flow, the speed, the density of the gas and the pressure difference cited in the table were calculated, each of which relate to the properties of the gases situated in the sintering furnace. The values were calculated for turned-on burners and burners that were not turned on.

The table shows that the total pressure difference in the area between the furnace inlet and the gas inlet disposed at the end of the sintering zone, and in the area between the gas inlet and the furnace outlet with turned-on burners, each case with 0.512 Pa, is approximately 2.5 times that of the value obtained when the burners are turned off. As a result, it is to be expected that gases and/or dispersoids pass from the burn-off zone by, for example, diffusion and, in particular, convection into the sintering zone. This was corroborated by measurement in a real sintering furnace under operating conditions.

FIG. 3*a* shows another embodiment of a sintering furnace 1 in a side view. The embodiment shown differs from the embodiment shown in FIG. 2*a* insofar as disposed within the transitional zone is a gas removal device 8, embodied as a line running from the interior of the sintering furnace 1 out to the environment. Inside the sintering furnace the gas removal device 8 joins a gas removal device opening 9, which, in the embodiment shown, is disposed below the transporting surface 7, which, in the embodiment shown is designed to be gas-permeable. The meaning of the other reference numerals as well as of the arrow indicating the direction of transport is the same as in FIG. 2*a*.

FIG. 3*b* schematically shows with arrows how, based on the experiments carried out, the gas flows essentially proceed within the sintering furnace 1 in its embodiment shown in FIG. 3*a* during its operation. The reference numerals correspond here to those of FIG. 3*a*. The dotted arrows indicate the directions of flow of sintering zone gas stemming from the area of the sintering zone 3. The solid arrows indicate directions of flow of burn-off zone gas in an area of the burn-off zone 2 and stemming from the area of the burn-off zone 2 flowing in the direction of the sintering zone 3. It is especially apparent that sintering zone gas flowing from the area of the sintering zone 3 into the area of the burn-off zone 2 is underflowed in an approximately wedge-shaped manner by burn-off zone gas flowing from the area of the burn-off zone 2 in the direction of the sintering zone 3 and in an area of the transitional zone 4. In addition, circulatory movements of burn-off zone gas also take place in the burn-off zone 2, which flow through the transporting surface 7, which is possible because the transporting surface in the embodiment shown is designed to be at least partially gas-permeable. FIG. 3*b* also shows that gas flowing from the burn-off zone 2 in the direction of the sintering zone 3 passes in one area of the transitional zone 4 through the gas removal device opening 9 into the gas removal device 8, and is finally conducted through the gas removal device out of the sintering furnace 1. Similarly, gas flowing out of the sintering zone 3 in the direction of the burn-off zone 2 moves during the passage through the transitional zone through the gas removal device opening 9 into the gas removal device 8 and is finally conducted through it out of the sintering furnace 1.

The following Table 2 shows a tabular listing of measuring data ascertained in a sintering furnace in an embodiment according to FIG. 3*a* with a gas removal device disposed in the transitional zone, whereby during the experiments carried out the longitudinal extension of the sintering zone and of the cooling zone in the direction of transport was in each case 6 m. The general conditions described in the description for table 1 regarding the determination of the cited values apply here. However, in contrast to Table 1, an additional column "gas exhaust" is added in Table 2, in which values obtained in one area of the gas removal device opening are entered.

TABLE 2

Values determined for a sintering furnace according to FIG. 3a and therefore with a gas removal device.

| | Burner | Furnace inlet | Burn-off zone | Gas exhaust | Transitional zone | Sintering zone 6 m gas inlet at the end | Cooling zone 6 m | Furnace outlet with curtains |
|---|---|---|---|---|---|---|---|---|
| Average gas temperature (° C.) | off | 700 | 700 | 800 | 1050 | 700 | 550 | 50 |
| | on | 700 | 700 | | 1050 | 700 | 550 | 50 |
| Mass flow (kg/s) | off | 0.0000 | 0.0000 | 0.0132 | 0.0132 | 0.0132 | 0.0068 | 0.0068 |
| | on | 0.0000 | 0.0180 | 0.0312 | 0.0132 | 0.0132 | 0.0068 | 0.0068 |
| Volume flow ($m^3$/s) | off | 0.000 | 0.000 | 0.040 | 0.050 | 0.037 | 0.016 | 0.006 |
| | on | 0.000 | 0.050 | 0.024 | 0.050 | 0.037 | 0.016 | 0.006 |
| Cross section ($m^2$) | | 0.072 | 0.500 | 0.072 | 0.072 | 0.126 | 0.072 | 0.072 |
| Speed (m/s) | off | 0.000 | 0.000 | 0.560 | 0.691 | 0.290 | 0.220 | 0.087 |
| | on | 0.000 | 0.100 | 0.337 | 0.691 | 0.290 | 0.220 | 0.087 |
| Density (kg/$m^3$) | off | 0.361 | 0.136 | 0.328 | 0.266 | 0.361 | 0.427 | 1.089 |
| | on | 0.361 | 0.361 | 1.288 | 0.266 | 0.361 | 0.427 | 1.089 |
| Ceta (–) | off | 2.99 | 0 | 1 | 1.87 | 0.72 | 0.72 | 30 |
| | on | 2.99 | 0 | 1 | 1.87 | 0.72 | 0.72 | 30 |
| Pressure difference (Pa) | off | (0.000) | (0.000) | (0.051) | 0.119 | 0.011 | 0.007 | 0.122 |
| | on | (0.000) | (0.000) | (0.073) | 0.119 | 0.011 | 0.007 | 0.122 |
| Total pressure difference (Pa) | off | | | | 0.130 | | 0.130 | |
| | on | | | | 0.130 | | 0.130 | |

The results cited in parentheses in Table 2 were not considered in the calculation of the total pressure difference. Table 2 shows in particular that the pressure difference between the furnace inlet and the gas inlet, as well as the pressure difference between the gas inlet and the furnace outlet, are significantly less with turned-on burners and also with turned-off burners than is cited for the sintering furnace without a gas removal device in Table 1. Consequently, it is to be expected that in comparison to the test procedure shown in FIG. 2*a*, a test procedure shown in FIG. 3*a* results to a much lower degree in a diffusion and/or convection of gas and/or dispersoids from the burn-off zone into the sintering zone. Furthermore, it is especially noteworthy from the results cited in Table 2 that due to the gas now extracted, the adjustment of the flow equilibrium does not depend on whether the burners are turned on or turned off.

FIG. 3*c* shows another embodiment of a sintering furnace 1 in a side view. The sintering furnace 1 shown in this FIG. 3*c* differs from the embodiment shown in FIG. 3*b* essentially in that gas inlet devices 20 designed as nozzles are disposed within the transitional zone 4 and above the gas removal device opening 9 Introducing protective gas with the aid of these gas introduction devices, particularly in one area of the transitional zone, causes an acceleration of gas stemming from both the first zone as well as from the second zone with at least one directional component in the direction of the gas removal device opening. This is outlined by the course of the arrows and their meaning is analogous to that of the arrows shown in FIG. 3*b*.

FIG. 3*d* shows a top view of a section of an embodiment of a sintering furnace 1, as is shown, for example, in a side view in FIG. 3*a*. In the embodiment shown, the parallel projection of the gas removal device opening 9 extends to the transporting surface 7 in the direction transverse to the direction of transport of the bodies to be sintered completely over the space between the two muffle walls 19, which constitute inner walls of the sintering furnace.

FIG. 3*e* shows another embodiment of a sintering furnace 1 in a side view. Similar to the embodiment shown in 3*a*, the sintering furnace 1 shown in FIG. 3*e* comprises a gas removal device 8 with a gas removal device opening 9 that is designed as a line running completely in one area of the transitional zone 4 from the interior of the sintering furnace 1 into the environment, wherein the transitional zone 4 in the example shown is formed between the adjacent first zone 2, which in this example is designed as a sudden cooling zone, and the second zone 3 adjacent to the other side of the transitional zone 4, which in this example is designed as a starting zone. However, in contrast to the example shown in FIG. 3*a*, the gas removal device opening is not disposed below the level of the transporting surface 7 in the exemplary embodiment of FIG. 3*e* but rather above the level of the transporting surface 7.

FIG. 3*f* schematically shows with arrows how the course of the gas flows inside the sintering furnace in its embodiment shown in FIG. 3*f* was essentially observed during an operation based on experiments carried out. In the example shown, the first zone 2 is designed as a sudden cooling zone whereas the second zone 3 is designed as a starting zone. Accordingly, the dotted-line arrows designate gas flowing substantially in the direction of the sudden cooling zone, whereas the solid arrows designate gas flowing inside the sintering furnace 1 from the sudden cooling zone substantially in the direction of the starting zone. Due to the distinctly higher prevailing temperatures in the starting zone in comparison to the sudden cooling zone, even the average gas temperature of the gases flowing out of the sudden cooling zone in the direction of the starting zone is lower than the average gas temperature of the gases stemming from the starting zone. The fact that in the example shown the gas removal device opening 9 is disposed above the transporting surface 7 ensures that the prevailing flow conditions, in comparison to the flow conditions shown in FIG. 3*b*, for example, are reflected on a plane parallel to the transporting surface 7. Therefore, in the example shown, it is possible to reduce the portion of gases stemming from the starting zone such as, for example, air, that moves into the sudden cooling zone.

FIG. 4*a* shows another embodiment of a sintering furnace 1. The embodiment shown here corresponds substantially to the embodiment shown in FIG. 3*a*. Unlike the former embodiment of FIG. 3*a*, FIG. 4 shows that a cross-section-narrowing body 10 is disposed above the transporting surface in an area of the transitional zone. The cross-section-narrowing body 10 in this case is rectangular in design and is fastened, possibly detachably, to the upper side of the muffle wall. The remaining reference numerals are assigned analogously to those of FIG. 3*a*.

FIG. 4*b* shows another embodiment of a sintering furnace 1 in which, in particular, a cross-section-changing body 11 is disposed within the transitional zone 4, which body can be moved in and out of the cross-sectional area of the transitional zone 4. In the embodiment shown the cross-section-changing body 11 is designed as a plate that is held in a guide and can be raised or lowered by a traction system. The remaining reference numerals are assigned analogously to those of FIG. 3*a*.

FIG. 4*c* shows another embodiment of a sintering furnace 1. The embodiment shown in FIG. 4*c* corresponds substantially to the embodiment shown in FIG. 4*a* but differs slightly from it, essentially in that the cross-section-narrowing body 10 is designed as lamella 21. In the embodiment shown, three lamellas are disposed within the transitional zone. The lamellas are disposed sequentially and equidistantly in the direction of the transport of the bodies to be sintered. However, it can also be possible for the number of lamellas to be greater than in the embodiment shown and for the aggregate of lamellas to extend into one or into both of the adjacent zones.

FIG. 4*d* schematically shows with arrows how, based on the experiments carried out, the gas flows essentially proceed inside the sintering furnace 1 in its embodiment shown in FIG. 4*c* during its operation. The reference numerals in this figure correspond to the reference numerals used in FIG. 2*b*. Dotted arrows in this case indicate flow directions of sintering zone gas stemming from the area of sintering zone 3. The solid arrows indicate flow directions of burn-off zone gas present in an area of the burn-off zone 2 and stemming from the area of the burn-off zone 2 and flowing in the direction of sintering zone 3. Moreover, circulatory movements of burn-off zone gas also take place inside the burn-off zone 2, which flow through the transporting surface 7, which is possible because the transporting surface in the embodiment shown is designed to be at least partially gas-permeable. In addition, FIG. 4*d* shows that gas flowing out of the burn-off zone 2 in the direction of the sintering zone 3 passes in an area of the transitional zone 4 through the gas removal device opening 9 into the gas removal device 8 and is finally conducted through the gas removal device out of the sintering furnace 1. Furthermore, it has been shown that circulatory movements are produced in an area between each two adjacent lamellas. Overall, when considering the aggregate of lamellas, the successive arrangement of lamellas in conjunction with the half spaces formed between each two adjacent lamellas, results in a significant elevation of the flow resistance, as a result of which the achieved effect schematically represented with the aid of the arrows in FIG. 4*d* is especially pronounced. The circulatory movements forming between each two adjacent lamellas proved to be the cause of this advantageous behavior.

FIG. 4*e* shows, based on measurements carried out on a sintering furnace 1 of the embodiment shown in FIG. 4*c*, how the relative flow resistance behaves in percent as a function of the lamella spacing in mm. Two lamellas were suspended at different intervals between 0 mm and 300 mm from one another in the transitional zone of the sintering furnace. In the diagram shown, the relative flow resistance of the two lamellas as a whole as a function of the lamella spacing is shown, wherein the flow resistance of a cross-section-narrowing body 10 positioned at the same position as a massive body was selected as benchmark whose flow resistance corresponds to 100%.

The results recorded in the diagram shown in FIG. 4*f* were determined by changing the number of lamellas, wherein the lamellas were positioned at equidistant intervals from each other along a direction pointing in the direction of transport of the bodies to be sintered. In the diagram shown, the relative flow resistance of the aggregate of lamellas is shown as a function of the lamella spacing, wherein the flow resistance of a cross-sectional narrowing body 10 positioned at the same position and designed as a massive body was selected as the benchmark whose flow resistance corresponds to 100%.

Of course, it can be provided that the aggregate of lamellas is not designed, as shown here, as a cross-section-narrowing body but rather as a cross-section-changing body and that the lamellas, for example, in the cross section of the transitional zone are designed so that they can be moved in and out of the cross section of the transitional zone. In this case, it can be provided that the aggregate of lamellas can be moved in and out as such, but also that the lamellas can be moved independently of each other.

As FIG. 4*e* and also FIG. 4*f* show, an optimal value for a reduced flow resistance can be achieved, which is approximately 150 mm in both tests, based on the two diagrams shown in FIG. 4*e* and in FIG. 4*f*.

FIG. 5*a* illustrates another embodiment of a sintering furnace 1 in a side view. The arrangement of a flow-through change component 12 disposed inside the gas removal device 8 is apparent from the FIG. 5*a*. The flow-through change component 12 is designed in the embodiment shown as a plate that can be moved laterally in and out of the cross section of the gas removal device 8. The other reference numerals are assigned analogously to those of FIG. 3*a*.

FIG. 5*b* illustrates another embodiment of a sintering furnace 1 in a side view. It is apparent from the figure shown that a convection-forcing device 13 is disposed inside the gas removal device 8. In the embodiment of the sintering furnace 1 shown, the convection-forcing device 13 is designed as an axial ventilator which, depending on the design, speed of rotation, direction of rotation or other parameters, causes a forced convection, which is superposed by existing natural convection. The other reference numerals are assigned analogously to those of FIG. 3*a*.

FIG. 5*c* illustrates another embodiment of a sintering furnace 1 in a side view. In the embodiment shown the sintering furnace comprises a flow-through change component 12 and also a convection-forcing device 13. The sintering furnace 1 also comprises a regulating circuit 14 for regulating the adjustment of the flow-through change component 12 and of the convection-forcing device 13. In the embodiment shown, a sensor for measuring the dew point temperature $T_{Tau}$ of water vapor present in the sintering zone is disposed as a measuring element of the regulating circuit 14.

FIG. 6 shows another embodiment of a sintering furnace 1 designed as a sintering belt furnace in a side view. The gas removal device 8 in the embodiment of the sintering furnace 1 shown leads to a heat exchanger 15, in which heat from gas removed from the sintering furnace 1 can be used to heat a fluid.

The invention claimed is:

1. A sintering furnace comprising a first zone, a second zone and a transitional zone disposed between the first zone and the second zone, at least one transport mechanism for transporting bodies to be sintered on a transporting surface from the first zone through the transitional zone to the second zone, and at least one gas removal device having at least one gas removal device opening, wherein the gas removal device opening is disposed at least partially in one area of the transitional zone and at a position beneath, at least in part, the transporting surface and further wherein the gas removal device opening is in continuous gaseous communication with the first zone and the second zone wherein in one area of the transitional zone at least one cross-section-changing body movable into the cross section of the transitional zone and movable out of the cross section of the transitional zone is disposed above the transporting surface.

2. The sintering furnace according to claim 1, characterized in that the transitional zone comprises at least one area, whose smallest cross-sectional surface is smaller than the cross-sectional surface of at least one zone adjacent to the transitional zone.

3. The sintering furnace according to claim 1, characterized in that the cross-section-narrowing body is designed as a lamella and that at least two lamellas are disposed successively and spaced apart from each other in the longitudinal direction of the sintering furnace, wherein at least one lamella is disposed within the transitional zone.

4. The sintering furnace according to claim 1, characterized in that the gas removal device opening is disposed in an area of the transitional zone.

5. The sintering furnace according to claim 1, characterized in that the first zone is a burn-off zone and that the second zone is a sintering zone.

6. A sintering furnace comprising a first zone, a second zone and a transitional zone disposed between the first zone and the second zone, at least one transport mechanism for transporting bodies to be sintered on a transporting surface from the first zone through the transitional zone to the second zone, and at least one gas removal device having at least one gas removal device opening, wherein the gas removal device opening is disposed at least partially in one area of the transitional zone and at a position beneath, at least in part, the transporting surface and further wherein the gas removal device opening is in continuous gaseous communication with the first zone and the second zone wherein a parallel projection of the gas removal device opening extends onto the transporting surface at least over the entire width of the transporting surface.

7. The sintering furnace according to claim 6, characterized in that at least one interchangeable cross-section-narrowing body is disposed at least partially in an area of the transitional zone above the transporting surface.

8. The sintering furnace according to claim 6, characterized in that the gas removal device opening is disposed at the level of the transporting surface or below the level of the transporting surface.

9. The sintering furnace according to claim 6, characterized in that the parallel projection of the gas removal device opening onto the transporting surface extends at least over the entire width of the transporting surface, preferably over the space between the lateral inner walls of the sintering furnace, which are designed as muffle walls.

10. A sintering furnace comprising a first zone, a second zone, and a transitional zone disposed between the first zone and the second zone, at least one transport mechanism for transporting bodies to be sintered on a transporting surface from the first zone through the transitional zone to the second zone, and at least one gas removal device having at least one gas removal device opening, wherein the gas removal device opening is disposed at least partially in one area of the transitional zone wherein at least one introduction device is disposed in an area of the transitional zone substantially opposite the gas removal device opening for introducing protective gas.

11. The sintering furnace according to claim 10, characterized in that at least one flow-through change component for the adjustment of volume flow flowing through the gas removal device is disposed in the gas removal device.

12. The sintering furnace according to claim 10, characterized in that at least one convection-forcing device for adjusting the volume flow flowing through the gas removal device is disposed inside the gas removal device.

13. The sintering furnace according to claim 10, characterized in that a volume flow can be adjusted by gas conducted by the gas removal device out of the sintering furnace.

14. A sintering furnace comprising a first zone, a second zone, and a transitional zone disposed between the first zone and the second zone, at least one transport mechanism for transporting bodies to be sintered on a transporting surface from the first zone through the transitional zone to the second zone, and at least one gas removal device having at least one gas removal device opening, wherein the gas removal device opening is disposed at least partially in one area of the transitional zone wherein the gas removal device, starting from the gas removal device opening leads to a heat exchanger for conducting gas from the sintering furnace to the heat exchanger in order to heat fluid there for its subsequent introduction into the sintering furnace.

15. A method for removing gases from a sintering furnace, characterized in that gas flowing between a first zone and a second zone passes a transitional zone disposed between the first zone and the second zone, and at least a portion of gas flowing from one of the two zones in the direction of the other of the two zones is conducted at least in one area of the transitional zone through at least one gas removal device opening into at least one gas removal device in which the at least one gas removal device opening is at a position beneath, at least in part, a transporting surface and further is in continuous gaseous communication with the first zone and the second zone, and is then removed from the sintering furnace by the gas removal device wherein the sintering furnace produces sintered bodies while gas flows and is removed from the sintering furnace.

16. The method according to claim 15, characterized in that as a result of natural convection a cooler of two gases including the gas flowing between the first zone and the second zone and the at least the portion of gas flowing from one of the two zones in the direction of the other of the two zones flows below the warmer of the two gases, and that at least a portion of the cooler of the two gasses enters at the level of the transporting surface and/or below the level of the transporting surface into the gas removal opening.

17. The method according to claim 15, characterized in that as a result of natural convection a cooler of two gases including the gas flowing between the first zone and the second zone and the at least the portion of gas flowing from one of the two zones in the direction of the other of the two zones flows below the warmer of the two gases, and that at least a portion of the warmer of the two gases enters at the level of the transporting surface and/or above the level of the transporting surface into the gas removal opening.

18. The method according to claim 15, characterized in that at least the portion of the gas flowing from one of the two zones in the direction of the other of the two zones passes through the gas removal device opening into the gas removal device as a result of natural convection, and is removed from the sintering furnace by the gas removal device as a further result of natural convection.

19. The method according to claim 15, characterized in that the gas flowing between the first and the second zone flows at least partially past at least one cross-section-narrowing body having at least one lamella, and as a result the direction of flow is changed in the direction of the gas removal device opening.

20. The method according to claim 15, characterized in that the volume flow of gas removed by the gas removal device and, as a result, the level of the portion of gas flowing from one of the two zones in the direction of the other of the two zones is adjusted, preferably raised, especially preferably regulated with the aid of at least one convection-forcing device disposed inside the gas removal device.

21. The method according to claim 15, characterized in that the first zone is a burn-off zone and that the second zone is a sintering zone.

22. The method according to claim 15 for producing non-oxidic sintered bodies.

23. A method for removing gases from a sintering furnace, characterized in that gas flowing between a first zone and a second zone passes a transitional zone disposed between the first zone and the second zone, and at least a portion of gas flowing from one of the two zones in the direction of the other of the two zones is conducted at least in one area of the transitional zone through at least one gas removal device opening into at least one gas removal device, and is then removed from the sintering furnace by the gas removal device wherein the portion of the gas flowing from one of the two zones in the direction of the other of the two zones is accelerated in the direction of the gas removal device by protective gas introduced in an area of the transitional zone substantially opposite the gas removal device opening, and is changed, preferably adjusted, especially preferably regulated as a result.

24. The method according to claim 23, characterized in that the adjustment of the level of the portion of the gas flowing from one of the two zones in the direction of the other of the two zones takes place as a regulating carried out by a regulating circuit.

25. The method according to claim 24, characterized in that a measuring element of the regulating circuit is a sensor for measuring the dew point temperature of vapor, preferably water vapor, present in the sintering furnace, preferably in an area of the second zone.

26. A method for removing gases from a sintering furnace, characterized in that gas flowing between a first zone and a second zone passes a transitional zone disposed between the first zone and the second zone, and at least a portion of gas flowing from one of the two zones in the direction of the other of the two zones is conducted at least in one area of the transitional zone through at least one gas removal device opening into at least one gas removal device, and is then removed from the sintering furnace by the gas removal device wherein the volume flow of gas removed by the gas removal device and, as a result, the level of the portion of the gas removed by the gas removal device flowing from one of the two zones in the direction of the other of the two zones, is adjusted, preferably regulated, with the aid of at least one flow-through change component disposed inside the gas removal device.

27. A method for removing gases from a sintering furnace, characterized in that gas flowing between a first zone and a second zone passes a transitional zone disposed between the first zone and the second zone, and at least a portion of gas flowing from one of the two zones in the direction of the other of the two zones is conducted at least in one area of the transitional zone through at least one gas removal device opening into at least one gas removal device, and is then removed from the sintering furnace by the gas removal device wherein at least the portion of the gas removed by the gas removal device, flowing out of one of the two zones in the direction of the other of the two zones, is conducted into a heat exchanger in which a heating of fluid takes place by the transfer of thermal energy from the portion of the gas removed.

28. A method for removing gases from a sintering furnace, characterized in that gas flowing between a first zone and a second zone passes a transitional zone disposed between the first zone and the second zone, and at least a portion of gas flowing from one of the two zones in the direction of the other of the two zones is conducted at least in one area of the transitional zone through at least one gas removal device opening into at least one gas removal device, and is then removed from the sintering furnace by the gas removal device wherein at least the portion of the gas removed by the gas removal device flowing out of one of the two zones in the direction of the other of the two zones, is conducted into a heat exchanger, in which a heating of protective gas to be introduced into the sintering furnace takes place by the transfer of thermal energy from the portion of the gas removed to the protective gas to be introduced into the sintering furnace.

* * * * *